US009578917B2

(12) United States Patent
Cohen

(10) Patent No.: US 9,578,917 B2
(45) Date of Patent: Feb. 28, 2017

(54) PROTECTIVE HELMETS

(71) Applicant: Yochanan Cohen, New York, NY (US)

(72) Inventor: Yochanan Cohen, New York, NY (US)

(73) Assignee: Pidyon Controls Inc., New York, NY (US)

( * ) Notice: Subject to any disclaimer, the term of this patent is extended or adjusted under 35 U.S.C. 154(b) by 284 days.

(21) Appl. No.: 14/171,283

(22) Filed: Feb. 3, 2014

(65) Prior Publication Data

US 2014/0196198 A1 Jul. 17, 2014

Related U.S. Application Data

(63) Continuation-in-part of application No. PCT/US2013/059626, filed on Sep. 13, 2013, and a continuation-in-part of application No. 13/617,663, filed on Sep. 14, 2012, now Pat. No. 8,640,267, and a continuation-in-part of application No. 13/670,961, filed on Nov. 7, 2012, now abandoned.

(51) Int. Cl.
*A42B 3/06* (2006.01)
*F41H 1/04* (2006.01)

(52) U.S. Cl.
CPC ..... *A42B 3/063* (2013.01); *F41H 1/04* (2013.01)

(58) Field of Classification Search
CPC ..... A42B 3/063; A42B 3/064; A42B 3/00; A42B 3/003; A42B 3/06; A42B 3/069; A42B 3/12; A42B 3/125; A42B 3/127; A42B 3/128; F41H 1/04
USPC ..... 2/414, 411, 425
See application file for complete search history.

(56) References Cited

U.S. PATENT DOCUMENTS

| | | | | |
|---|---|---|---|---|
| 2,911,652 A | | 11/1959 | Ekman | |
| 3,015,104 A | | 1/1962 | Crosson et al. | |
| 3,023,134 A | | 2/1962 | Creswell et al. | |
| 3,174,155 A | | 3/1965 | Pitman | |
| 3,186,004 A | | 6/1965 | Carlini | |
| 3,242,500 A | * | 3/1966 | Derr | A42B 3/063 2/205 |
| 3,320,619 A | | 5/1967 | Latsnik et al. | |

(Continued)

OTHER PUBLICATIONS

Helmets Preventing Concussion Seen Quashed by NFL-Riddell, John Helyar, Mar. 18, 2013, Bloomberg.

*Primary Examiner* — Alissa L Hoey
(74) *Attorney, Agent, or Firm* — Gordon & Jacobson, P.C.

(57) ABSTRACT

Embodiments of a protective helmet have a cushioning outer multilayer structure with at least two cushioning layers of materials having different densities and different geometric layouts, a multilayer hard inner structure attached to the interior surface of the cushioning multilayer structure, and an innermost cushioning structure attached to the inner surface of the multilayer hard inner structure. The multilayer hard inner structure is formed from at least two spaced layers of hard material and a layer of cushioning material therebetween. The innermost cushioning structure may be a multilayer structure similar to the outer multilayer structure with at least two cushioning layers of materials having different densities and different geometric layouts. The innermost cushioning structure may include sensors, optionally in a separate layer, and a thermal-control layer. A flexible thin cover extending around an outer surface of said shell and with or without graphics may be provided.

22 Claims, 18 Drawing Sheets

(56) References Cited

U.S. PATENT DOCUMENTS 3,479,666 A 11/1969 Webb
3,577,562 A 5/1971 Holt
3,818,508 A 6/1974 Lammers
3,829,900 A * 8/1974 Marangoni ..... A42B 3/065 2/414
3,906,546 A 9/1975 Gooding
4,101,983 A 7/1978 Dera et al.
4,106,124 A 8/1978 Green
4,345,338 A 8/1982 Frieder, Jr. et al.
4,484,364 A 11/1984 Mitchell et al.
4,599,752 A 7/1986 Mitchell
4,845,786 A 7/1989 Chiarella
4,937,888 A 7/1990 Straus
4,972,527 A 11/1990 Wallace
5,018,220 A 5/1991 Lane et al.
5,056,156 A * 10/1991 Kosmo ..... A42B 3/063 2/2.11
5,204,998 A 4/1993 Liu
5,259,071 A 11/1993 Scott et al.
5,475,878 A 12/1995 Dawn et al.
5,638,544 A 6/1997 Sump
5,680,656 A 10/1997 Gath
5,724,681 A 3/1998 Sykes
5,930,840 A 8/1999 Arai
5,956,777 A 9/1999 Popovich
6,032,297 A 3/2000 Barthold et al.
6,272,692 B1 8/2001 Abraham
6,282,724 B1 * 9/2001 Abraham ..... A41D 13/015 2/267
6,314,586 B1 * 11/2001 Duguid ..... A42B 3/069 2/411
6,389,607 B1 5/2002 Wood
6,421,840 B1 7/2002 Chen et al.
6,446,271 B1 * 9/2002 Ho ..... A42B 3/12 2/414
6,604,246 B1 * 8/2003 Obreja ..... A42B 3/06 2/411
6,658,671 B1 * 12/2003 Von Holst ..... A42B 3/12 2/412
6,709,062 B2 3/2004 Shah
6,912,736 B2 7/2005 Moeller et al.
6,931,671 B2 8/2005 Skiba
7,062,795 B2 6/2006 Skiba et al.
7,328,462 B1 2/2008 Straus
7,526,389 B2 * 4/2009 Greenwald ..... A42B 3/046 2/425
7,536,731 B1 5/2009 Feldman
7,676,854 B2 3/2010 Berger et al.
7,765,621 B2 8/2010 Lardeau
7,765,622 B2 8/2010 Wiles
7,802,320 B2 9/2010 Morgan
7,802,321 B2 9/2010 Boyd
7,832,023 B2 11/2010 Crisco
7,930,771 B2 4/2011 Depreitere et al.
7,987,525 B2 8/2011 Summers et al.
8,020,220 B2 9/2011 McElroy et al.
8,166,573 B1 5/2012 Chung et al.
8,209,784 B2 7/2012 Nimmons et al.
8,235,461 B2 8/2012 Cohen
8,640,267 B1 2/2014 Cohen
8,887,312 B2 * 11/2014 Bhatnagar ..... A42B 3/063 2/2.5
2001/0032351 A1 10/2001 Nakayama et al.
2003/0135914 A1 * 7/2003 Racine ..... A42B 3/122 2/413
2004/0250339 A1 12/2004 Musal
2004/0255370 A1 12/2004 Moeller
2005/0278834 A1 12/2005 Lee
2006/0059605 A1 3/2006 Ferrara
2006/0059606 A1 3/2006 Ferrara
2006/0162053 A1 7/2006 Lee
2006/0162054 A1 * 7/2006 Lardeau ..... A42B 3/127 2/414
2006/0242752 A1 11/2006 Talluri
2006/0277664 A1 12/2006 Akhtar
2007/0107112 A1 5/2007 Boyd
2007/0119538 A1 5/2007 Price
2007/0130673 A1 6/2007 Wasserkrug
2007/0157370 A1 7/2007 Joubert Des Ouches
2007/0226881 A1 10/2007 Reinhard et al.
2008/0222782 A1 9/2008 Stokes
2009/0222964 A1 9/2009 Wiles
2010/0005571 A1 * 1/2010 Moss ..... A42B 3/046 2/410
2011/0047678 A1 3/2011 Barth et al.
2011/0107503 A1 5/2011 Morgan
2011/0179557 A1 7/2011 Rabie
2011/0203024 A1 8/2011 Morgan
2012/0060251 A1 3/2012 Schimpf
2012/0151663 A1 6/2012 Rumbaugh
2012/0186002 A1 7/2012 Bhatnagar et al.
2012/0216339 A1 8/2012 Nimmons et al.
2012/0233745 A1 9/2012 Veazie
2013/0125294 A1 5/2013 Ferrara
2013/0305435 A1 * 11/2013 Surabhi ..... A42B 3/067 2/414
2013/0340147 A1 12/2013 Giles

* cited by examiner

PROTECTIVE HELMETS

This application claims priority from PCT/US2013/059626 filed on Sep. 13, 2013, from U.S. Ser. No. 13/617,663 filed on Sep. 14, 2012 and from U.S. Ser. No. 13/670,961 filed on Nov. 7, 2012, which are all hereby incorporated by reference in their entirety herein.

BACKGROUND

1. Field

The present disclosure relates to helmets. More particularly, the present disclosure relates to protective helmets having enhanced protective performance characteristics. The present disclosure has application to football helmets, ice-hockey helmets, baseball helmets, motorcycle helmets, riot helmets, military helmets and other similar helmets, although it is not limited thereto.

2. State of the Art

Head trauma resulting from sports and other activities is a common occurrence. Generally, head trauma occurs when an object impacts the head, thereby transferring energy to the head. The most common head trauma resulting from sports is a concussion, which occurs when the brain bangs inside the skull and is bruised. To reduce the incidence of concussion, it is common practice to wear a protective helmet. Protective helmets are ostensibly designed to deflect and absorb energy transmitted by impact to the helmet, thereby diminishing the risk of head and brain injury resulting from the impact.

Protective athletic helmets have been worn for almost a century, and have evolved from sewn leather, to helmets having molded plastic outer shells with suspension webbing or other head fitting structures such as foam pads, air bladders, or padded molding on their interior. Despite the evolution of the protective helmets, the reported rate of concussions has been increasing amongst student and professional athletes in many sports. While some experts have attributed this increase to better reporting and diagnosis, other experts have attributed the increase to increased forces generated as competitive athletes continue to increase in size (mass) and increase their ability to accelerate.

What has not been necessarily considered is that the increase in concussions actually may be attributable to the structure of the evolved protective helmets. In particular, the molded hard plastic helmets have not been shown to absorb energy effectively as they tend to transmit pressure waves, and in helmet to helmet contact situations may actually add to trauma. In addition, the evolved protective helmets have a considerable weight that may lead to other injuries.

It is also known that head trauma resulting in traumatic brain injury (TBI) has become a common occurrence in the military. A common cause of TBI is damage caused by explosive devices such as improvised explosive devices (IEDs).

TBI injuries fall into several categories that may have different symptoms. Mild TBI (MTBI), commonly referred to as a concussion, is a brief loss of consciousness or disorientation ranging up to thirty minutes. Although brain damage may not be visible on an MRI or CAT scan, common symptoms of MTBI include headache, confusion, lightheadedness, dizziness, blurred vision, ringing in the ears, fatigue or lethargy, behavioral or mood changes, and trouble with memory, concentration or attention. Severe traumatic brain injury is associated with loss of consciousness for over thirty minutes or amnesia. Symptoms of severe TBI include all those of MTBI as well as headaches that increase in severity or do not abate, repeated vomiting or nausea, convulsions or seizures, dilation of the eye pupils, slurred speech, weakness or numbness in the extremities, loss of coordination, and increased confusion or agitation. TBI injuries can cause lasting physical and cognitive damage.

Presently, the U.S. army utilizes the Advanced Combat Helmet (ACH) that incorporates ballistic fiber such as KEVLAR (a trademark of DuPont of Wilmington, Del.), TWARON (a trademark of Teijin Twaron, B.V. of the Netherlands), or ultra-high-molecular-weight polyethylene (UHMWPE). The ACH has a suspension system including a rear suspension system to which a ballistic "nape pad" is attached. The nape pad is intended to reduce soldier deaths from shrapnel wounds to the neck and lower head.

Despite the introduction of the ACH, TBI injuries continue to be a major cause of concern.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A protective helmet includes a multilayered system including at least two outer cushioning layers having different densities and different geometric layouts, a hard structure located inside the outer cushioning layers, and at least one inner cushioning layer located inside the hard structure.

In one embodiment, the outer layer of the at least two outer cushioning layers is a cushioning outer shell, and an inner layer of the at least two outer cushioning layers is a spacer layer with a different geometry than the cushioning outer shell and which is arranged to redirect energy transmitted from the cushioning outer shell along a circuitous path to air and the hard inner structure.

In one embodiment, the hard structure located inside the outer cushioning layers is a multilayer structure with at least two hard layers and at least one cushioning layer therebetween. For example, the at least two hard layers may composite carbon fiber structures, and the cushioning layer may be structural foam or a liquid gel.

In one embodiment, the at least one inner cushioning layer located inside the hard inner structure includes at least two cushioning layers having different densities and different geometric layouts. In one embodiment, the at least two cushioning layers located inside the inner structure are similar in densities and geometry to the at least two outer cushioning layers. In another embodiment, the at least one inner cushioning layer located inside the hard inner structure is a plurality of innermost cushioning pads coupled to the inside of the hard inner structure.

In one embodiment, one or more of the inner cushioning layers located inside the hard inner structure is provided with a plurality of spaced impact sensors.

In one embodiment, an innermost cushioning layer incorporates a thermal or climate control system that can be used to absorb, store and release heat for thermal comfort.

In one embodiment, the cushioning outer shell is covered by a flexible thin cover. The flexible thin cover may be a fabric, film, foil, or other cover. The flexible thin cover may be cosmetic and may provide a surface for printing graphics. The flexible thin cover may also protect the cushioning outer shell from damage.

In one embodiment, the cushioning spacer layer includes a plurality of elements glued or otherwise attached to the cushioning outer shell and to the hard inner structure. In another embodiment, the cushioning spacer layer comprises a single member defining a plurality of spaces.

In one embodiment the cushioning spacer layer member or elements at least partially overlie the spaces defined by the hard inner structure.

In one embodiment one or more of cushioning layers or elements is formed from a foam material such as an elastomeric, cellular foam material. In another embodiment, one or more of the cushioning layers is made of thermoplastic polyurethane (TPU). In one embodiment, one or more of the cushioning layers is made from a microcellular urethane foam.

A military helmet includes a multilayered system including at least two outer cushioning layers having different densities and different geometric layouts, a hard ballistic resistant structure located inside the outer cushioning layers, and at least one inner cushioning layer located inside the hard structure.

In one embodiment, the outer layer of the at least two outer cushioning layers is a cushioning outer shell, and an inner layer of the at least two outer cushioning layers is a spacer layer with a different geometry than the cushioning outer shell and which is arranged to redirect energy transmitted from the cushioning outer shell along a circuitous path to air and the hard ballistic resistant structure.

In one aspect, the at least two outer cushioning layers of the military helmet serve the purpose of absorbing or deflecting an acoustic shock wave that can impact the military helmet in advance of the impact of a projectile (e.g., bullet).

In one embodiment, the hard ballistic resistant structure located inside the outer cushioning layers is a multilayer structure with at least two ballistic fiber composite layers and at least one cushioning layer therebetween. For example, the at least two ballistic fiber composite layers may be a material such as KEVLAR, and the cushioning layer may be structural foam or a liquid gel.

In one embodiment, the cushioning outer shell of the military helmet is covered by a flexible thin cover. The flexible thin cover may be a fabric, film, foil, or other cover such as a ballistic nylon (a high denier nylon thread with a dense basket weave) that is used as a cover for the ACH. The flexible thin cover may provide a surface for printing graphics (e.g., camouflage). The flexible thin cover may also protect the cushioning outer shell from damage.

In one embodiment, one or more of the inner cushioning layers of the military helmet located inside the hard ballistic resistant inner structure is provided with a plurality of spaced impact sensors.

In one embodiment, an innermost cushioning layer of the military helmet incorporates a thermal or climate control system that can be used to absorb, store and release heat for thermal comfort.

DETAILED DESCRIPTION

Figure 1:
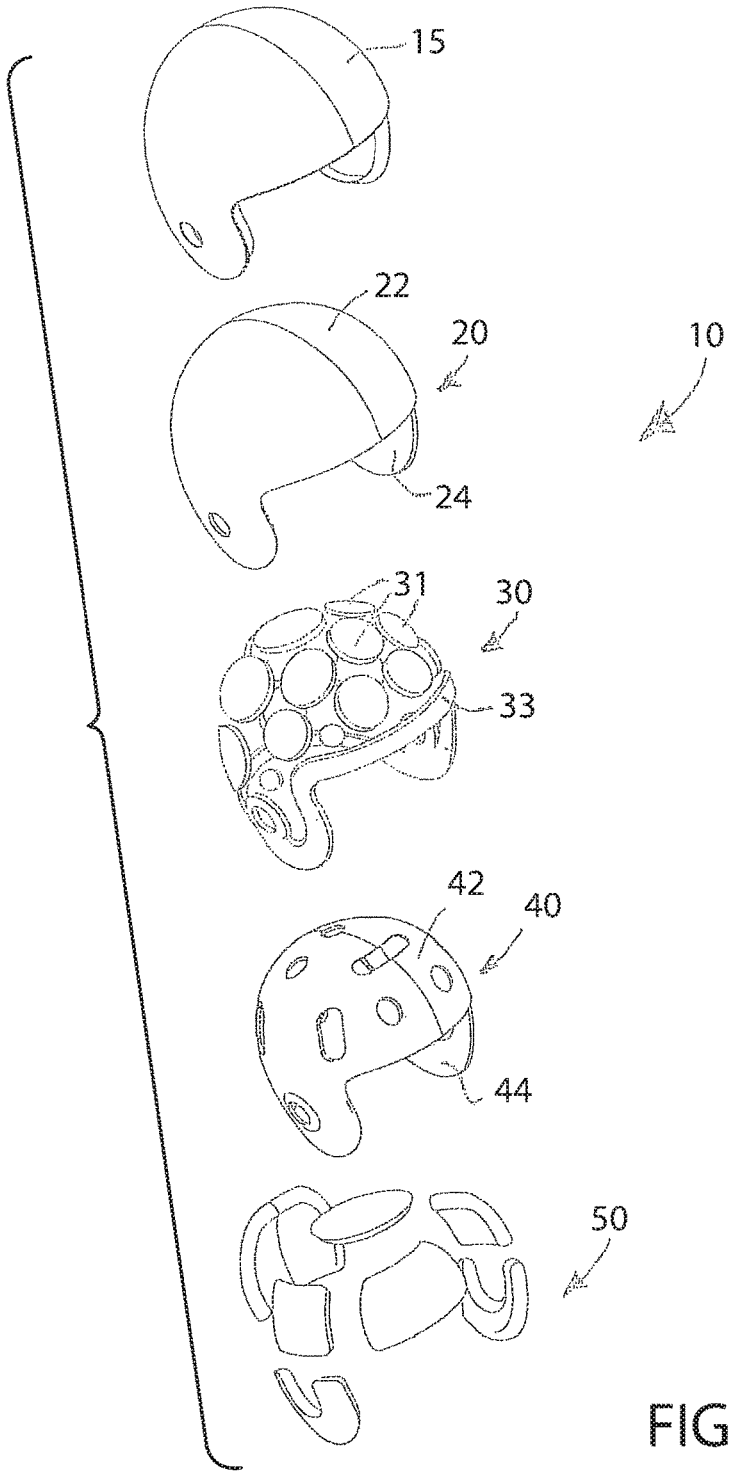
FIG. 1 is a perspective exploded view of a first embodiment of a helmet.
Figure 2:
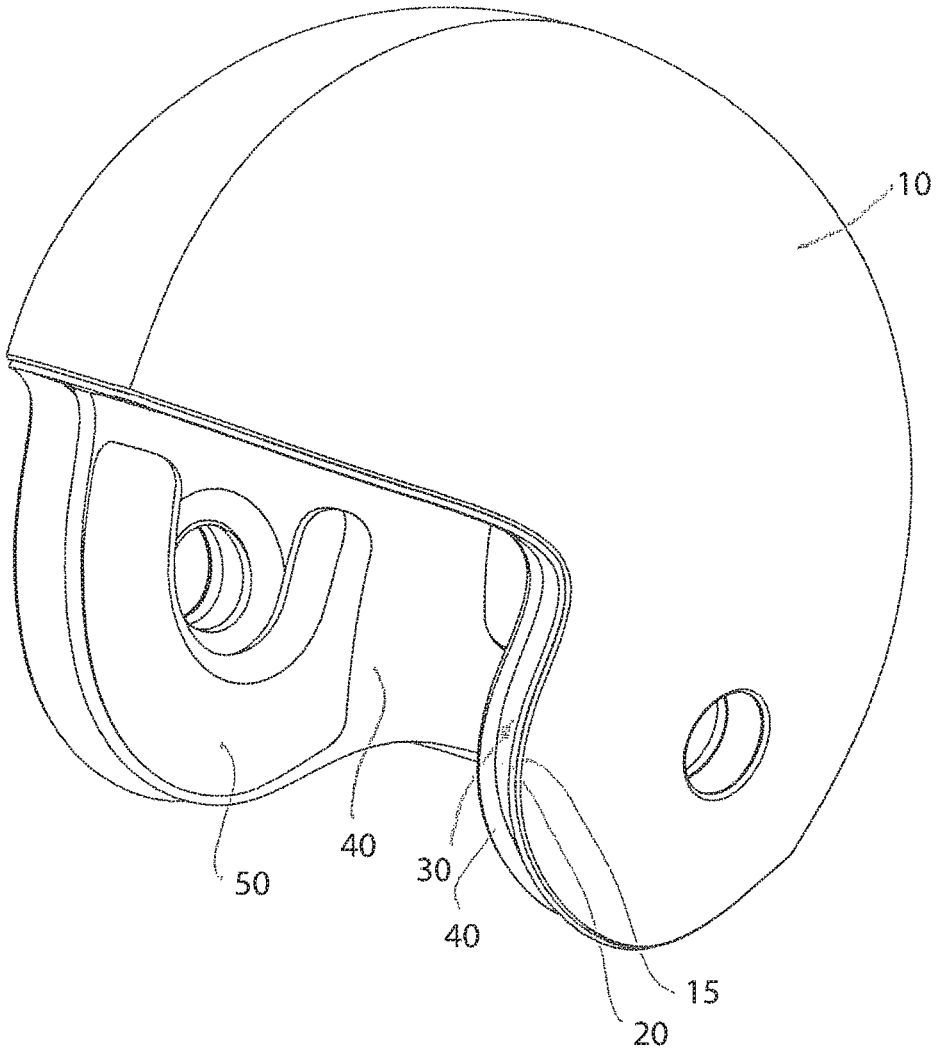
FIG. 2 is a front perspective view of the first embodiment.
Figure 3:
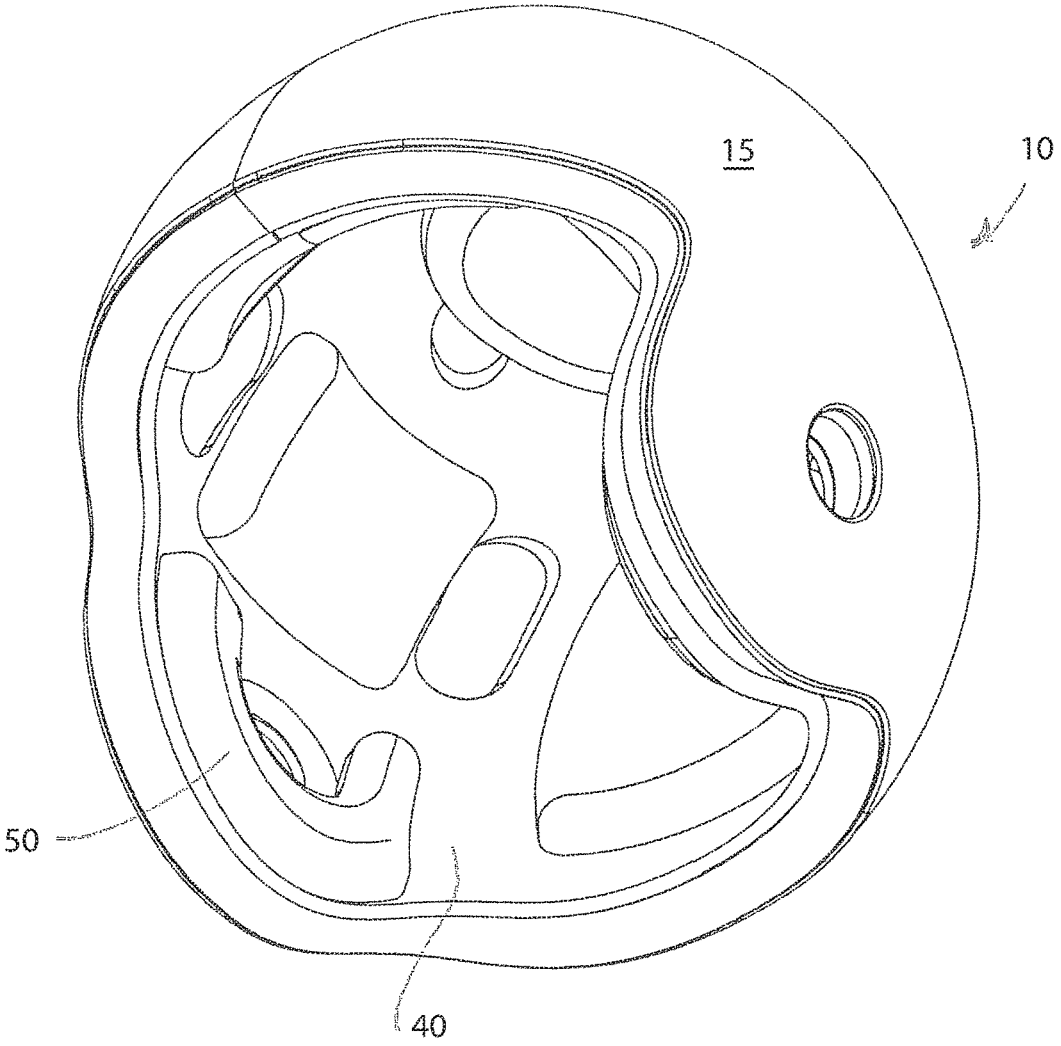
FIG. 3 is an inside perspective view of the first embodiment.
Figure 4:
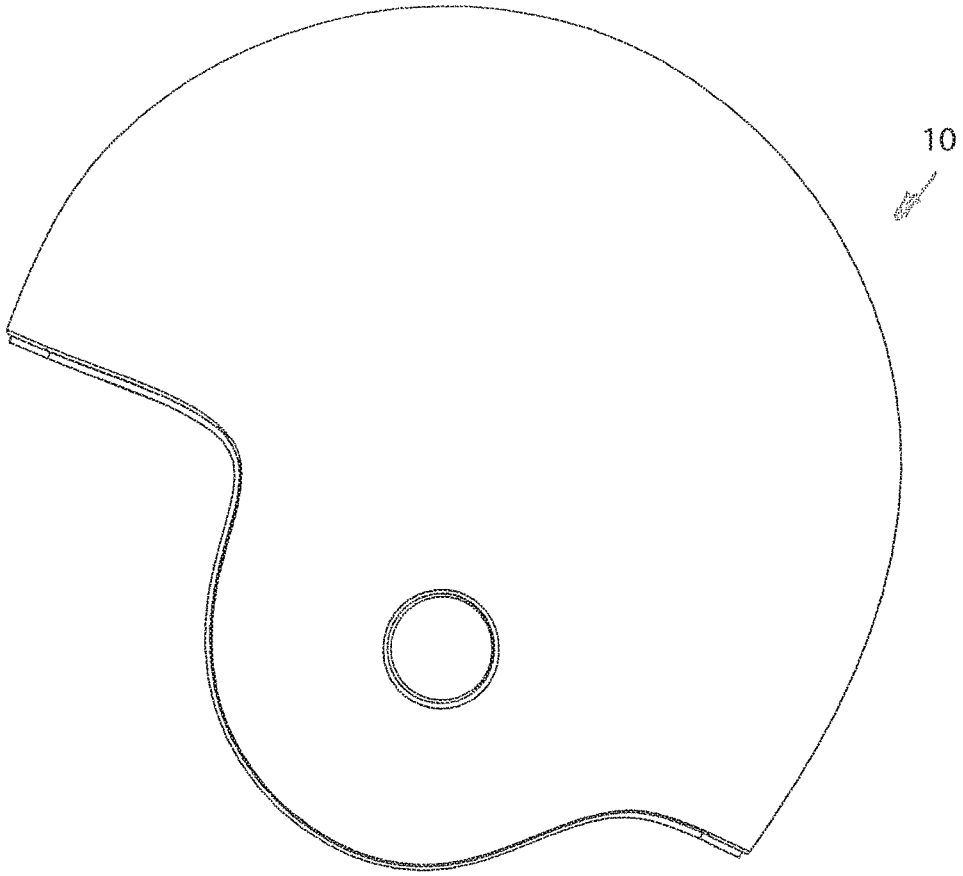
FIG. 4 is a side view of the first embodiment.

One embodiment of a protective helmet 10 is seen in FIGS. 1-5. Helmet 10 includes a multilayered system including an optional outermost cover 15, a cushioning outer shell 20 having an outer surface 22 and an inner surface 24, a hard inner structure 40 with an outer surface 42 and an inner surface 44, a cushioning spacer layer 30 located between and separating the cushioning outer shell 20 and the hard inner structure 40, and one or more innermost cushioning pads 50 coupled to the inside surface 44 of the hard inner structure 40. The innermost cushioning pads 50 may be covered by another fabric layer 55. As will be discussed in more detail hereinafter, the cushioning spacer layer 30 separates the cushioning outer shell 20 from the hard inner structure 40 and redirects energy transmitted from the cushioning outer shell along a circuitous path to air gaps and to the hard inner structure, thereby causing dissipation of pressure wave energy. Pressure wave energy that does reach the hard inner structure 40 is further dissipated by the innermost cushioning pads 50 before reaching the head of the helmet user (not shown).

In one aspect, the material of the hard inner structure 40 is considerably harder than the material(s) of the cushioning outer shell layer 20 and the cushioning spacer layer 30. In another aspect, the material(s) of the cushioning outer shell layer 20 and the cushioning spacer layer are resilient. In one embodiment, the cushioning spacer layer defines gaps that are non-uniform in shape and/or in size.

With the structure of helmet 10, when the helmet is hit by a projectile, the energy imparted by the projectile to the helmet can take various paths. First, it should be appreciated that the cushioning outer shell 20 will absorb and/or distribute some or all of the energy. The energy may be absorbed by (resilient) deflection of the foam cushioning. If some of the energy passes through the cushioning outer shell 20 it can either pass into the cushioning spacers 30 or into the air between the cushioning spacers. Again, if the energy pass into the cushioning spacers, the energy may be absorbed by (resilient) deflection of the cushioning spacers. Alternatively or in addition, the energy may be absorbed in the air between the cushioning spacers. Energy passing through the cushioning spacer level will reach the hard inner structure 40 or air gaps therein where it can be one or more of reflected, distributed, absorbed or transmitted. Typically, the hard inner structure 40 will not absorb much energy. As a result, the function of the hard inner structure 40 is primarily one of lending structural integrity to the helmet 10. Any energy passing through the hard inner structure or the air gaps therein will be passed to the innermost cushioning pads 50 (also typically resilient) or the air gaps between the pads where the energy again may be absorbed by (resilient) deflection of the cushioning pads 50 or by the air gaps therein. With all of these possible paths, it will be appreciated that the energy imparted by impact to the helmet will be significantly dissipated before reaching the head of the user. In addition, by forcing the energy through a tortuous path due to the use of cushioning and multiple layers with air gaps, the resistance to the energy shock waves by the helmet is increased. In this manner, the incidence of brain concussions of wearers of the helmet 10 can be reduced.

Figure 5:
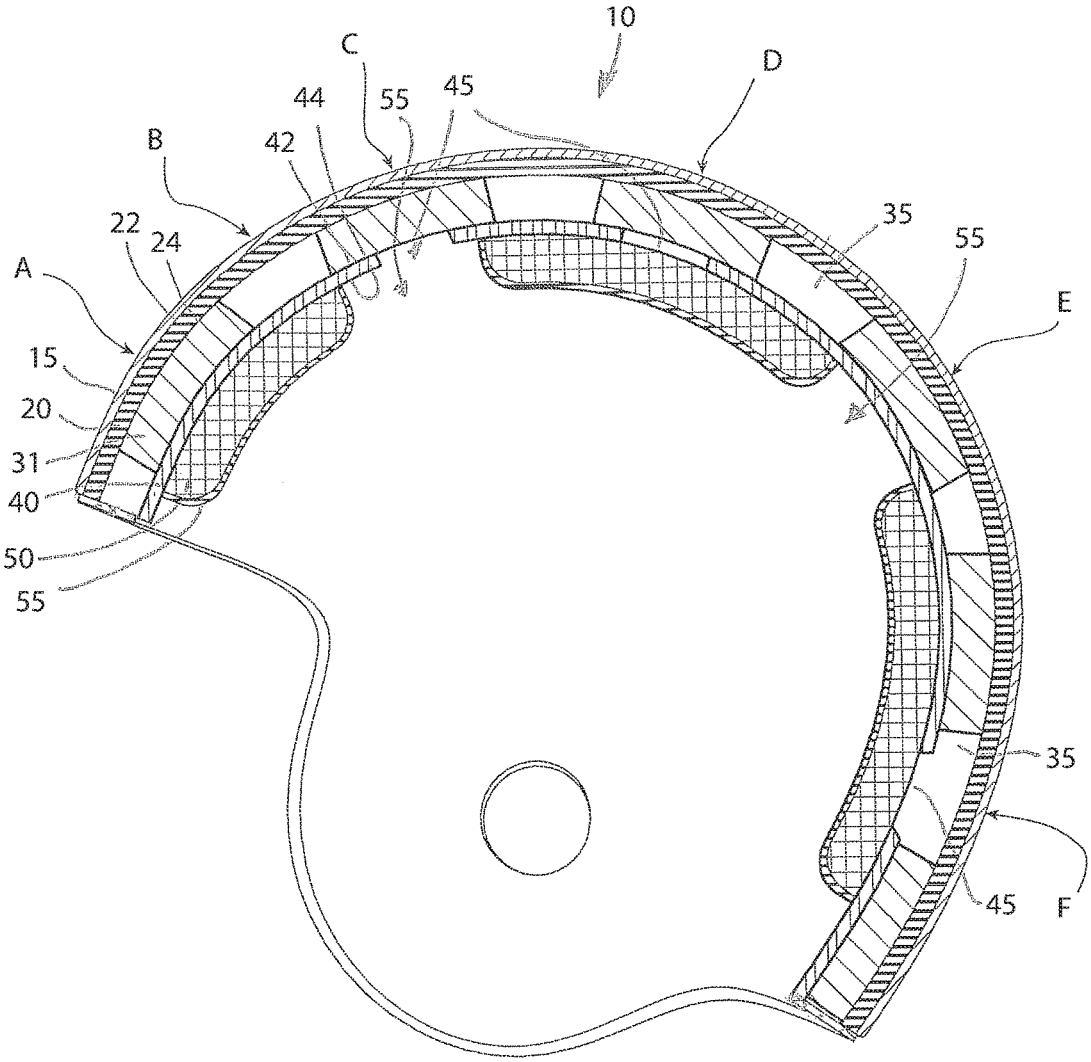
FIG. 5 is a cross-sectional view of the first embodiment.

Some of the energy paths through the helmet can be seen by reference to the FIG. 5 which shows six different cross-sectional paths through the helmet. A first cross section at location A through the helmet shows a fabric cover 15, the cushioning shell 20, a cushioning spacer pad 30, a hard inner structure 40, an inner cushioning pad 50, and an inner fabric cover 55 for the inner cushioning pad 50. Location B shows the cover 15, cushioning shell 20, space 35 (e.g., air between the cushioning spacer pads 30), the hard inner structure 40, an inner cushioning pad 50, and an inner fabric cover 55 for the inner cushioning pad 50. Location C includes cover 15, the cushioning shell 20, a cushioning pad 30, space 45 (e.g., air at gaps in the hard shell 40), and additional space 55 (e.g., air at gaps between the inner cushioning pads 50). Location D shows the cover 15, the cushioning shell 20, space 35 (e.g., air between the cushioning spacer pads 30), additional space (e.g., air at gaps in the hard shell 40), an inner cushioning pad 50, and fabric cover 55. Location E includes the cover 15, the cushioning shell 20, the cushioning spacer pad 30, the hard inner structure 40, and space 55 (e.g., air gap between the inner cushioning pads 50). Location F shows the cover 15, the cushioning shell 20, space 35 between the cushioning spacer pads 30, space 45 (air gaps in the hard shell), an inner cushioning pad 50 and fabric cover 55.

It should be appreciated that the described cross-sections give certain energy paths through the helmet 10, but that many other exist, and it is not necessary that all of these paths exist simultaneously in a helmet. In fact, it will be appreciated that energy waves will generally take a path of least resistance through a substance which may not correspond exactly to any of the cross-sections. Because harder substances will generally transmit energy waves more readily than air, the air gaps will cause the energy to travel and spread radially through the cushioning shell 20 and the hard inner structure 40. However, travel through a longer distance in the cushioning shell 20 and the hard inner structure 40 causes further attenuation of the energy.

In one embodiment, the flexible thin cover 15 may be a fabric, film, foil, leather, or other cover. The flexible thin cover may be cosmetic and may provide a surface for printing graphics. The flexible thin cover may also protect the cushioning outer shell from damage. If desired, the flexible thin cover may extend around the periphery of the helmet (as suggested in FIG. 5 but not shown in FIGS. 2 and 3) to protect the periphery of the cushioning shell 20 and the cushioning spacer layer 30 and optionally the hard inner structure 40 and even the innermost cushioning pads 50. Alternatively, if desired, a flexible band may be used to extend around the periphery and cover the peripheral edge of cushioning shell 20, the spacer layer 30 and optionally the hard layer 40. In one embodiment, the flexible thin cover is made from ballistic nylon, a high denier nylon thread with a dense basket wave such as Cordura (a trademark of Invista, Wichita, Kans.). In another embodiment, the flexible thin cover is made from a Neoprene (a trademark of DuPont, Del.) rubber (polychloroprene) fabric. In another embodiment, the flexible thin cover is made from leather or artificial leather. In another embodiment, the flexible thin cover is made from a polyester fabric. In another embodiment, the flexible thin cover is made from non-woven fabric. In another embodiment, the flexible thin cover is made from a printable film. By way of example only, the thin cover may be between 0.1 mm and 10 mm thick, although it may be thinner or thicker. By way of another example, the flexible thin cover may be between 0.3 mm and 3.25 mm thick. By way of another example, the flexible thin cover may be between 1.0 mm and 1.5 mm thick. The thin cover 15 may be attached at one or more places to the cushioning shell 20, so that the cover may be removed from the shell 20 without damaging the shell. By way of example only, attachment may be made by use of Velcro (a trademark of Velcro USA Inc., Manchester, N.H.). Alternatively, the thin cover may be glued, tacked or sewn to the shell 20. In one embodiment, the thin cover 15 covers the entire cushioning shell 20.

In one embodiment the cushioning shell 20 is comprised of foam. The foam may be an elastomeric, cellular (including microcellular) foam or any other desirable foam. In another embodiment, the cushioning shell is comprised of a soft resilient thermoplastic polyurethane (TPU) (i.e., having a Shore hardness considerably below the Shore hardness of the hard inner structure). In another embodiment, the cushioning shell is comprised of open-cell polyurethane. In another embodiment, the cushioning shell is comprised of closed cell polyolefin foam. In another embodiment, the cushioning shell is comprised of polyethylene foam which may be a high or low density polyethylene foam. In one embodiment, the outer surface 22 of the cushioning shell 20 is generally (hemi)-spherical in shape. By way of example and not by way of limitation, the cushioning shell may be between 3 mm and 13 mm thick, although it may be thinner or thicker. By way of example, and not by way of limitation, the cushioning shell may have a density of between 3.4 $lbs/ft^3$ (approximately 0.016 $g/cm^3$) and 25 $lbs/ft^3$ (approximately 0.4 $g/cm^3$), although it may be more dense or less dense.

Figure 6A:
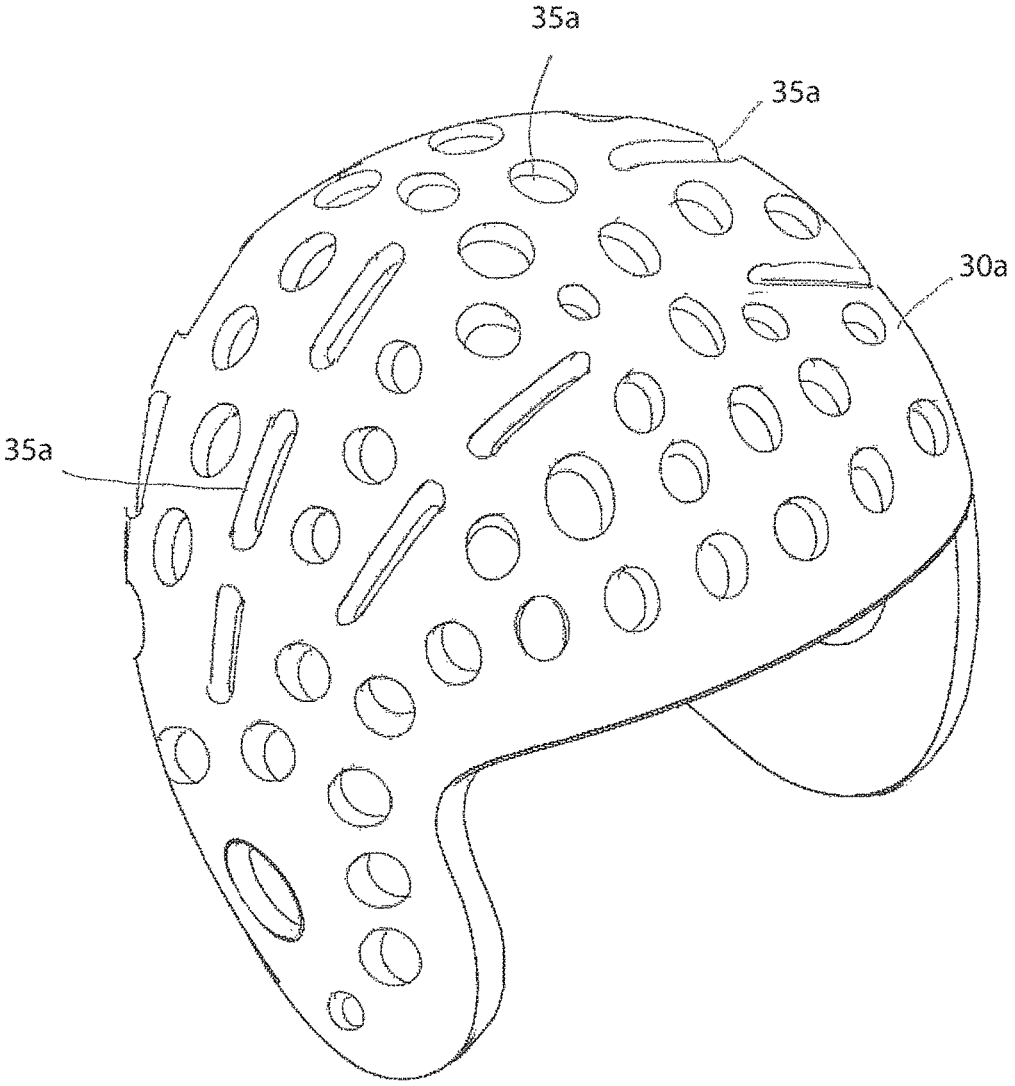
FIG. 6*a* is a perspective view of an alternative cushioning spacer layer.

In one embodiment the cushioning spacer layer 30 comprises a plurality of pads 31. The pads 31 may be circular in shape or may be formed in other shapes. Multiple shapes may be used together. In one embodiment, the spacer layer may include a strip of material 33 (seen in FIG. 1) around the peripheral edge of the helmet between the shell 20 and the hard inner structure 40 that can prevent foreign material from entering between the shell 20 and the hard inner structure 40. In another embodiment (seen in FIG. 6*a*) the cushioning spacer layer is a single pad 30*a* defining multiple cut-outs 35*a* (i.e., the equivalent of multiple connected pads). In one embodiment the spacer layer 30 is comprised of foam. The foam may be an elastomeric, cellular (including microcellular) foam or any other desirable foam. In another embodiment, the cushioning spacer layer is comprised of a soft resilient thermoplastic polyurethane (TPU) that is considerably softer than the hard inner structure 40. In another embodiment, the cushioning spacer layer is comprised of open-cell polyurethane. In another embodiment, the cushioning spacer layer is comprised of closed cell polyolefin foam. In another embodiment, the cushioning spacer layer is comprised of a microcellular urethane foam such as PORON (a trademark of Rogers Corporation). In another embodiment, the cushioning spacer layer is comprised of polyethylene foam which may be a high or low density polyethylene foam. In another embodiment, the cushioning spacer layer 30 has multiple layers formed from different materials. By way of example and not by way of limitation, the cushioning spacer layer may be between 3 mm and 26 mm thick, although it may be thinner or thicker. As another example, the cushioning spacer layer may be between 6 and 13 mm thick. By way of example, and not by way of limitation, the cushioning spacer layer may have a density of between 3.4 lbs/ft$^3$ (approximately 0.016 g/cm$^3$) and 30 lbs/ft$^3$ (approximately 0.48 g/cm$^3$), although it may be more dense or less dense.

According to one embodiment, the spacer layer 30 covers approximately fifty percent of the inner surface area of the shell 20. In another embodiment, the spacer layer 30 covers between twenty percent and ninety-five percent of the inner surface area of the shell. The spacer layer 30 should cover sufficient area between the shell 20 and the hard inner structure 40 so that upon most expected impacts to the helmet 10, the shell 20 does not directly come into contact with the hard inner structure 40. Regardless of the material and arrangement of the cushioning spacer layer 30, in one embodiment the cushioning material is affixed to the shell 20 and to the hard inner structure. Affixation can be done with glue, Velcro or any other affixation means.

In one embodiment, the hard inner structure 40 is comprised of a polycarbonate shell. In another embodiment, the hard inner structure 40 is comprised of a different hard plastic such a polypropylene. In another embodiment, the hard inner structure 40 is comprised of ABS resin. In another embodiment, the hard inner structure 40 is made of carbon fiber or fiberglass. In another embodiment, the hard inner structure is made of a polypropylene which is considerably harder than the materials of the cushioning layer 20 and spacer layer 30. Generally, the hardness of the hard inner structure may be characterized by a hardness on the Shore D Durometer scale (typically Shore D 75 and over), whereas generally, the hardness of the materials of the cushioning layer 20 and the spacer layer 30 are characterized by a hardness on the Shore A Durometer scale (typically Shore A 60 and under, and even more typically Shore A 30 and under). In one embodiment, as shown in FIGS. 1 and 5, the hard inner structure 40 defines a plurality of cut-outs 45. In one embodiment at least one of the cut-outs 45 is at least partially covered by a cushioning spacer pad 30. In another embodiment, at least one of the cut-outs 45 is at least partially covered by an inner cushioning pad 50. As previously mentioned, in one embodiment the hard inner structure 40 is affixed to the spacer layer 30. Affixation can be done with glue, Velcro or any other affixation means. By way of example and not by way of limitation, the hard inner structure is between 1.5 mm and 6.0 mm thick, although it may be thinner or thicker. As another example, the hard inner structure 40 is between 2.5 mm and 3.1 mm thick.

In one embodiment, the one or more innermost cushioning pad(s) 50 is comprised of foam. The foam may be an elastomeric, cellular (including microcellular) foam or any other desirable foam. In another embodiment, the cushioning pad(s) 50 is comprised of a soft resilient thermoplastic polyurethane (TPU). In another embodiment, the cushioning pad(s) is comprised of open-cell polyurethane. In another embodiment, the cushioning pad(s) is comprised of closed cell polyolefin foam. In another embodiment, the cushioning pad(s) is comprised of polyethylene foam which may be a high or low density polyethylene foam. In one embodiment the innermost cushioning pad 50 is a single pad defining multiple cut-outs (i.e., the equivalent of multiple connected pads). In another embodiment, a plurality of innermost cushioning pads 50 are provided. Regardless, the single pad with the cut-outs or the multiple pads are arranged in a desired configuration and are affixed to the hard inner structure 40. Affixation can be done with glue, Velcro or any other affixation means. By way of example and not by way of limitation, the innermost cushioning layer may be between 3 mm and 26 mm thick, although it may be thinner or thicker. By way of example, and not by way of limitation, the innermost cushioning pads may have a density of between 3.4 lbs/ft$^3$ (approximately 0.016 g/cm$^3$) and 25 lbs/ft$^3$ (approximately 0.4 g/cm$^3$), although they may be more dense or less dense.

In one embodiment, the innermost cushioning pad(s) 50 is covered by a fabric layer 55 (seen in FIG. 5). In one embodiment, fabric layer 55 is absorbent. In one embodiment fabric layer 55 is removable from the foam pad(s) 50. In one embodiment, the flexible thin cover is made from ballistic nylon, a high denier nylon thread with a dense basket wave such as Cordura (a trademark of Invista, Wichita, Kans.). In another embodiment, the flexible thin cover is made from a Neoprene (a trademark of DuPont, Del.) rubber (polychloroprene) fabric. In another embodiment, the flexible thin cover is made from leather or an artificial leather. In another embodiment, the flexible thin cover is made from a polyester fabric. In another embodiment, the flexible thin cover is made from non-woven fabric. By way of example only, the thin cover may be between 0.3 mm and 3.25 mm thick, although it may be thinner or thicker. By way of another example, the flexible thin cover may be between 1.0 mm and 1.5 mm thick.

Figure 6B:
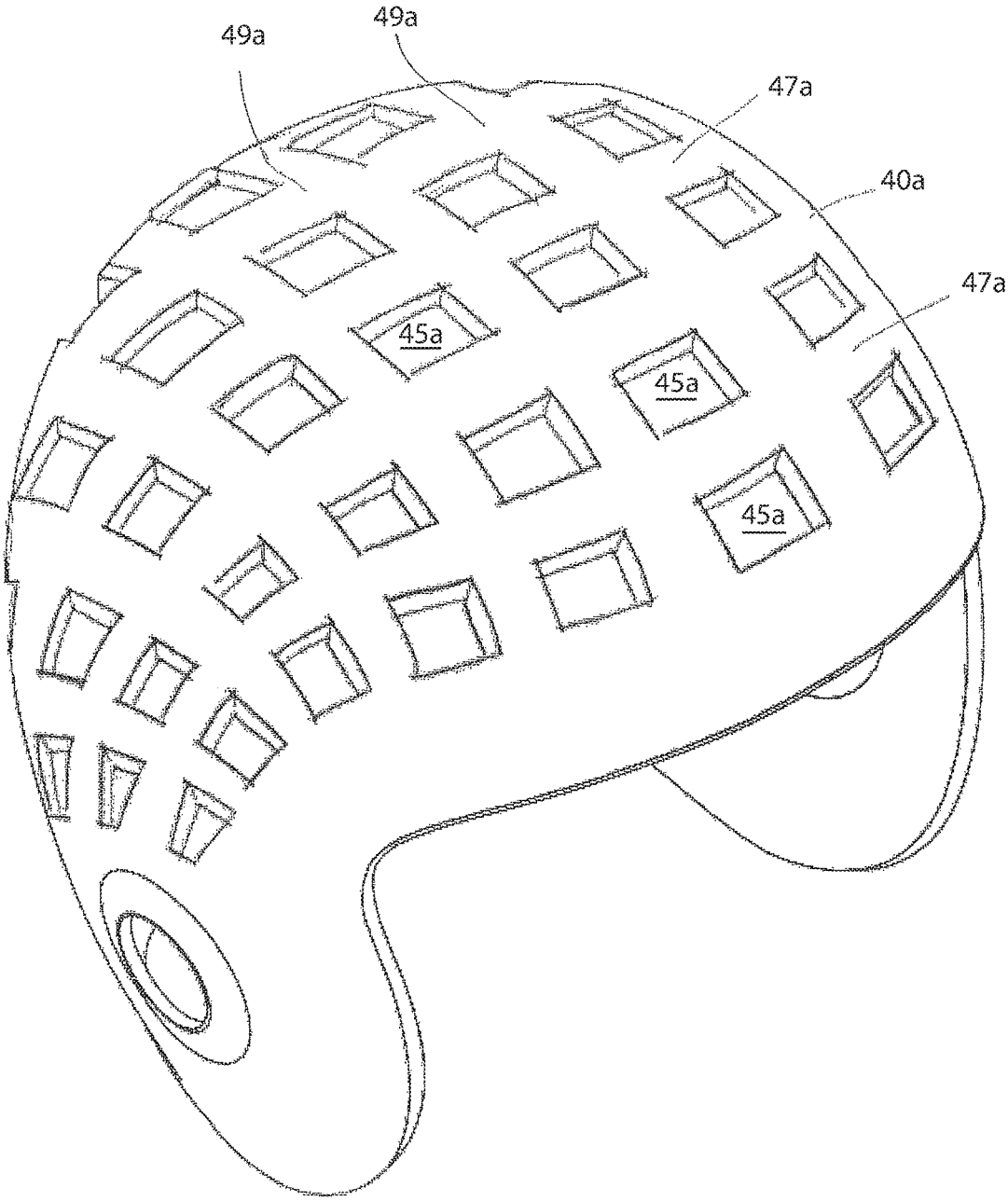
FIG. 6*b* is a perspective view of an alternative hard inner structure.

Turning to FIG. 6*b*, an alternative hard inner structure 40*a* is shown. Hard inner structure 40*a* includes a plurality of horizontal frame members 47*a* and lateral frame members 49*a* that together define spaces 45*a*. As will be appreciated, hard inner structure 40*a* effectively defines a lattice for support of the remainder of the helmet. However, by using less material, the weight of the hard inner structure and hence the helmet may be reduced. In the embodiment of FIG. 6*b*, the spaces 45*a* are roughly equal in area to one-half the area taken by the frame members 47*a* and 49*a*. In another embodiment, the spaces 45*a* are roughly equal to between one-quarter and twice the area taken by the frame members 47*a* and 49*a*.

Figure 7A:
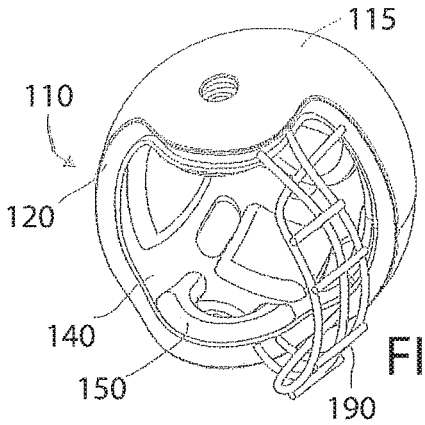
FIGS. 7*a* and 7*b* are bottom and perspective views of an embodiment of a football helmet.
Figure 7B:
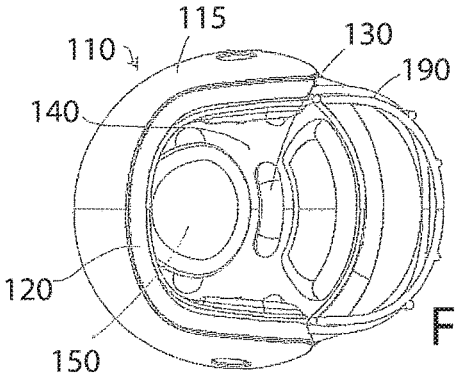

The helmets previously described may be used as or in conjunction with football helmets, ice-hockey helmets, baseball helmets, motorcycle helmets, riot helmets, and other similar helmets, although they are not limited thereto. Thus, for example, a riot helmet can have a polycarbonate face extending from the front face of the helmet. As seen in FIGS. 7*a* and 7*b*, a football helmet 110 is provided with the layered structure described above with reference to FIGS. 1-5 (outermost cover 115, a cushioning outer shell 120, a hard inner structure 140, a cushioning spacer layer 130 located between and separating the cushioning outer shell 120 and the hard inner structure 140, and one or more innermost cushioning pads 150 coupled to the inside surface of the hard inner structure 140) in conjunction with a face guard 190. In one embodiment, the face guard 190 is of the type that can break away from the remainder of the helmet 110 when subjected to excessive twisting forces.

In one embodiment, the football helmet 110 has a thickness of between 20 mm and 50 mm, although it may be thinner or thicker.

Figure 8:
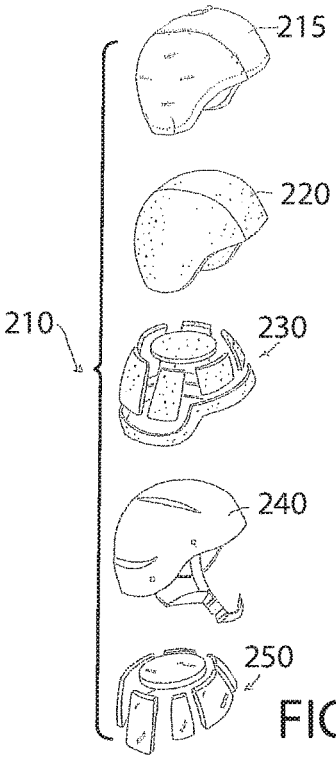
FIG. 8 is a perspective exploded view of an embodiment of a military helmet.
Figure 9:
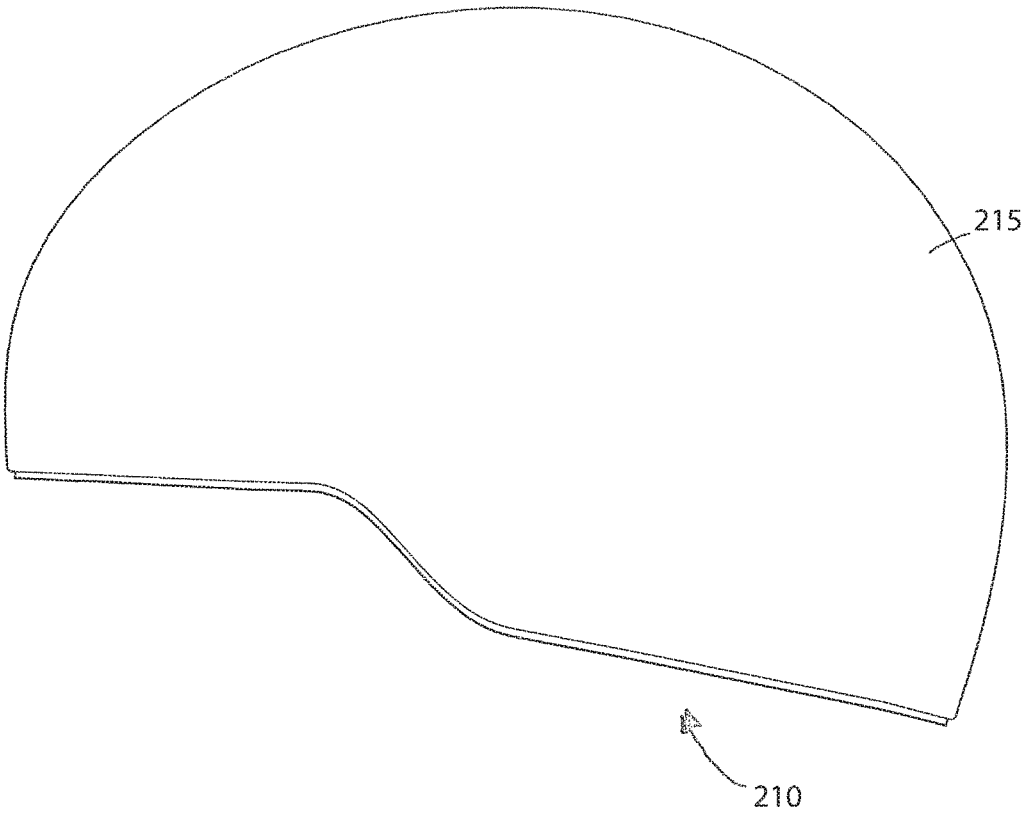
FIG. 9 is a side view of the military helmet embodiment.
Figure 10:
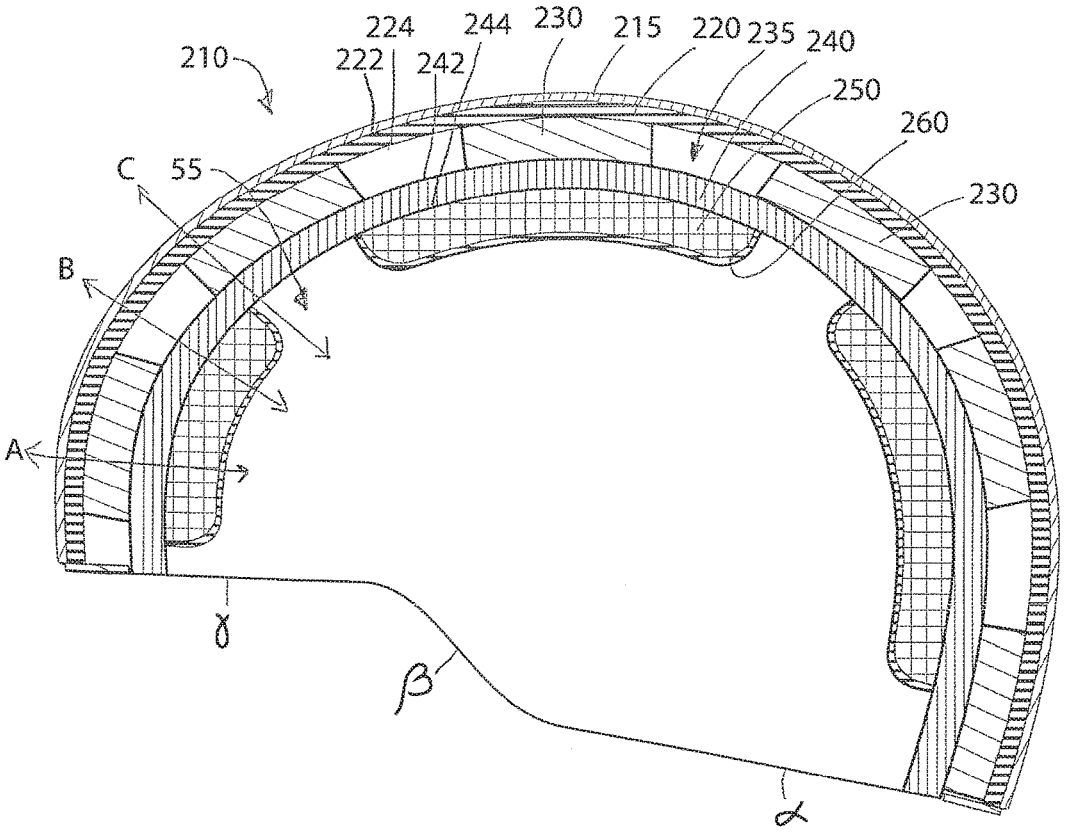
FIG. 10 is a cross-sectional view of military helmet embodiment.

One embodiment of a military helmet 210 is seen in FIGS. 8-10. Helmet 210 includes a multilayered system including an optional outermost cover 215, a cushioning outer shell 220 having a convex outer surface 222 and a concave inner surface 224, a hard ballistic-resistant inner shell 240 with a convex outer surface 242 and a concave inner surface 244, a cushioning spacer layer 230 located between and separating the cushioning outer shell 220 and the hard inner shell 240, and one or more innermost cushioning pads 250 coupled to the inside surface 244 of the hard inner shell 240. The innermost cushioning pads 250 may be covered by another fabric layer 260. As will be discussed in more detail hereinafter, the cushioning spacer layer 230 separates the cushioning outer shell 220 from the ballistic-resistant inner shell 240 and redirects energy transmitted from the cushioning outer shell along a circuitous path to air gaps and to the ballistic-resistant inner shell, thereby causing dissipation of shock (pressure) wave energy. Pressure wave energy that does reach the ballistic-resistant inner shell 240 is further dissipated by the innermost cushioning pads 250 before reaching the head of the helmet user (not shown).

When a projectile is shot at the helmet, before the projectile reaches the helmet, an energy wave hits the helmet. This energy wave can be a significant percentage of the total energy (energy or shock wave energy plus projectile energy) that impacts the helmet. In fact, in some circumstances, it is possible that only a shock wave is received, in which case, the shock wave is 100% of the total energy impacting the helmet. The military helmet 210 is designed to lessen the total energy impact on its user in two separate manners. First, the energy wave can take various paths. For example, it should be appreciated that the cushioning outer shell 220 will absorb and/or distribute some or all of the energy. The energy may be absorbed by deflection of the foam cushioning. If some of the energy passes through the cushioning outer shell 220 it can either pass into the cushioning spacers 230 or into the air between the cushioning spacers. Again, if the energy passes into the cushioning spacers, the energy may be absorbed by deflection of the cushioning spacers. Alternatively or in addition, the energy may be absorbed in the air between the cushioning spacers. Energy passing through the cushioning spacer level will reach the hard inner shell where it can be one or more of reflected, distributed, absorbed or transmitted. Energy passing through the hard inner ballistic-resistant will be passed to the innermost cushioning pads 250 or the air gaps between the pads where the energy again may be absorbed by deflection of the cushioning pads 250 or by the air gaps therein. With all of these possible paths, it will be appreciated that the energy imparted by the energy shock wave will be significantly dissipated before reaching the head of the user. In addition, by forcing the energy wave through a tortuous path due to the use of cushioning and multiple layers with air gaps, the resistance to the energy shock waves by the helmet is increased. In this manner, the incidence of brain concussions of wearers of the military helmet 210 can be reduced.

The military helmet 210 is also adapted to lessen the impact of the projectile itself. In particular, while the cushioning outer shell 220 and the cushioning spacer layer 230 will not appreciably stop the projectile, the hard inner shell 240 formed from a ballistic-resistant material will act to stop the projectile in the manner of the previously described with reference to the Advanced Combat Helmet.

Some of the energy paths through the helmet can be seen by reference to FIG. 10 which shows three different cross-sectional paths through the military helmet. A first cross section at location A through the military helmet shows a fabric cover 215, the cushioning shell 220, a cushioning spacer pad 230, a ballistic-resistant inner shell 240, an inner cushioning pad 250, and an inner fabric cover 260 for the inner cushioning pad 250. Location B shows the cover 215, cushioning shell 220, space 235 (e.g., air between the cushioning spacer pads 230), the ballistic-resistant inner shell 240, an inner cushioning pad 250, and an inner fabric cover 260 for the inner cushioning pad 250. Location C includes the cover 215, the cushioning shell 220, the cushioning spacer pad 230, the ballistic-resistant inner shell 240, and space 255 (e.g., air gap between the inner cushioning pads 50).

It should be appreciated that the described cross-sections give certain energy paths through the military helmet 210, but that many other exist, and it is not necessary that all of these paths exist simultaneously in a military helmet. In fact, it will be appreciated that energy waves will generally take a path of least resistance through a substance that may not correspond exactly to any of the cross-sections. Because harder substances will generally transmit energy waves more readily than air, the air gaps will cause the energy to travel and spread radially through the cushioning shell 220 and the hard inner shell 240. However, travel through a longer distance in the cushioning shell 220 and the ballistic-resistant inner shell 240 causes further attenuation of the energy.

In one embodiment, the flexible thin cover 215 may be a fabric, film, foil, or other cover such as a ballistic nylon (a high denier nylon thread with a dense basket weave) that is used as a cover for the ACH. The flexible thin cover may provide a surface for printing graphics, e.g., camouflage (see FIG. 12). The flexible thin cover may also protect the cushioning outer shell from damage. If desired, the flexible thin cover may extend around the periphery of the helmet (as suggested in FIG. 10) to protect the periphery of the cushioning shell 220 and the cushioning spacer layer 230 and optionally the hard inner shell 240 and even the innermost cushioning pads 250. Alternatively, if desired, a flexible band may be used to extend around the periphery and cover the peripheral edge of cushioning shell 220, the spacer layer 230 and optionally the hard shell 240. In one embodiment, the flexible thin cover is made from ballistic nylon, a high denier nylon thread with a dense basket weave such as Cordura (a trademark of Invista, Wichita, Kans.). In another embodiment, the flexible thin cover is made from a Neoprene (a trademark of DuPont, Del.) rubber (polychloroprene) fabric. In another embodiment, the flexible thin cover is made from a polyester fabric. In another embodiment, the flexible thin cover is made from leather or artificial leather. In another embodiment, the flexible thin cover is made from non-woven fabric. In another embodiment, the flexible thin cover is made from a printable film. In another embodiment, the flexible thin cover is made from a para-aramid synthetic fiber such as KEVLAR (a trademark of DuPont of Wilmington, Del.). In another embodiment the flexible thin cover comprises TWARON (a trademark of Teijin Twaron, B.V. of the Netherlands). In another embodiment, the flexible thin cover is made from a ultra-high-molecular-weight polyethylene. By way of example only, the thin cover may be between 0.1 mm and 10 mm thick, although it may be thinner or thicker. By way of another example, the flexible thin cover may be between 0.3 mm and 3.25 mm thick. By way of another example, the flexible thin cover may be between 1.0 mm and 1.5 mm thick. The thin cover 215 may be attached at one or more places to the cushioning shell 220, so that the cover may be removed from the shell 220 without damaging the shell. By way of example only, attachment may be made by use of Velcro (a trademark of Velcro USA Inc., Manchester, N.H.). Alternatively, the thin cover may be glued, tacked or sewn to the shell 220. In one embodiment, the thin cover 215 covers the entire cushioning shell 220.

In one embodiment the cushioning shell 220 is comprised of foam. The foam may be an elastomeric, cellular (including microcellular) foam or any other desirable foam. In another embodiment, the cushioning shell is comprised of a soft resilient thermoplastic polyurethane (TPU). In another embodiment, the cushioning shell is comprised of open-cell polyurethane. In another embodiment, the cushioning shell is comprised of closed cell polyolefin foam. In another embodiment, the cushioning shell is comprised of polyethylene foam which may be a high or low density polyethylene foam. In all embodiments, the hardness of the cushioning shell is much lower than the hardness of the ballistic-resistant inner shell 240. For example, the hardness of the cushioning shell is typically described by the Shore A Durometer scale (typically Shore A 60 and under, and even more typically Shore A 30 and under), whereas the hardness of the ballistic-resistant inner shell is described by the Shore D Durometer scale.

In one embodiment, the outer surface 222 of the cushioning shell 220 is generally (hemi-)spherical in shape. By way of example and not by way of limitation, the cushioning shell may be between 3 mm and 13 mm thick, although it may be thinner or thicker. By way of example, and not by way of limitation, the cushioning shell may have a density of between 3.4 lbs/ft$^3$ (approximately 0.016 g/cm$^3$) and 25 lbs/ft$^3$ (approximately 0.4 g/cm$^3$), although it may be more dense or less dense.

Figure 11:
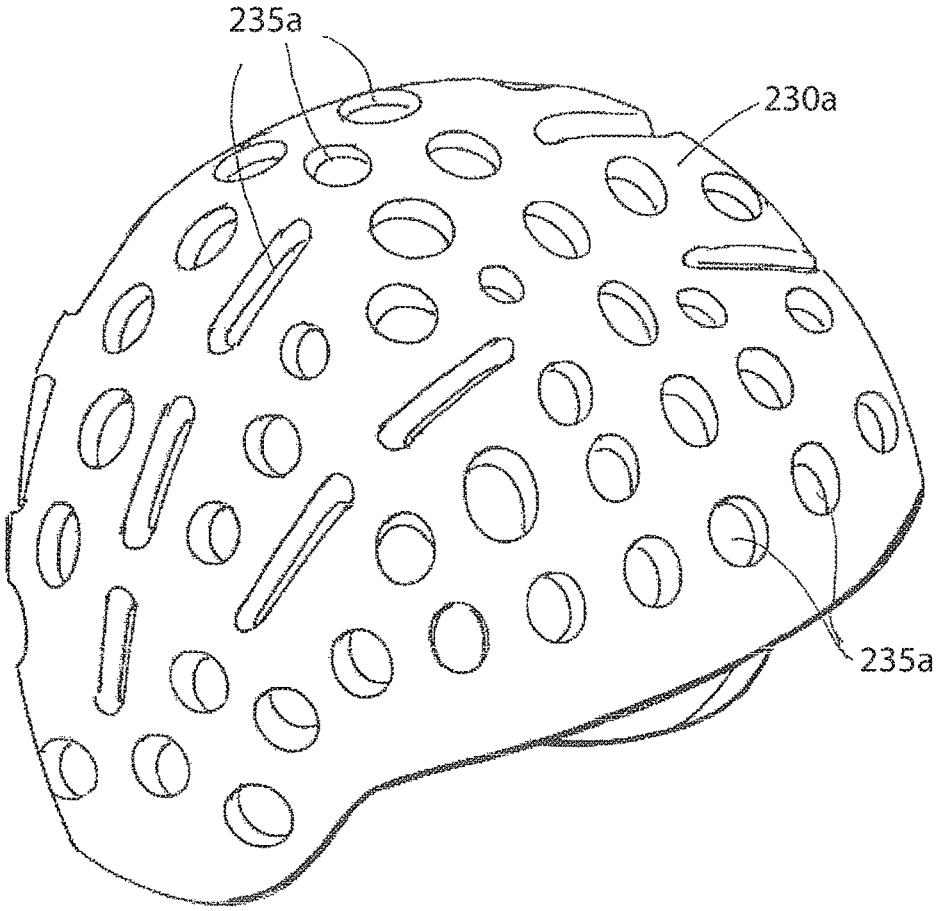
FIG. 11 is a perspective view of an alternative cushioning spacer layer for the military helmet.

In one embodiment the cushioning spacer layer 230 comprises a plurality of pads 231. The pads 231 may be circular in shape or may be formed in other shapes. Multiple shapes may be used together. In one embodiment, the spacer layer may include a strip of material 233 (seen in FIG. 8) around the peripheral edge of the military helmet between the shell 220 and the hard inner shell 240 that can prevent foreign material from entering between the shell 220 and the hard inner shell 240. In another embodiment (seen in FIG. 11) the cushioning spacer layer is a single pad 230*a* defining multiple cut-outs 235*a* (i.e., the equivalent of multiple connected pads). In one embodiment the spacer layer 230 is comprised of foam. The foam may be an elastomeric, cellular (including microcellular) foam or any other desirable foam. In another embodiment, the cushioning spacer layer is comprised of a soft resilient thermoplastic polyurethane (TPU). In another embodiment, the cushioning spacer layer is comprised of open-cell polyurethane. In another embodiment, the cushioning spacer layer is comprised of closed cell polyolefin foam. In another embodiment, the cushioning spacer layer is comprised of polyethylene foam which may be a high density or low density polyethylene foam. In another embodiment, the cushioning spacer layer 230 has multiple layers formed from different materials. In all embodiments, the hardness of the cushioning spacer layer material is much lower than the hardness of the ballistic-resistant inner shell. By way of example and not by way of limitation, the cushioning spacer layer may be between 3 mm and 26 mm thick, although it may be thinner or thicker. As another example, the cushioning spacer layer may be between 6 and 13 mm thick. By way of example, and not by way of limitation, the cushioning spacer layer may have a density of between 3.4 lbs/ft$^3$ (approximately 0.016 g/cm$^3$) and 25 lbs/ft$^3$ (approximately 0.4 g/cm$^3$), although it may be more dense or less dense.

According to one embodiment, the spacer layer 230 covers approximately fifty percent of the inner surface area of the shell 220. In another embodiment, the spacer layer 230 covers between twenty percent and eighty percent of the inner surface area of the shell. The spacer layer 230 should cover sufficient area between the shell 220 and the hard inner shell 240 so that upon most expected impacts to the helmet 210, the shell 220 does not directly come into contact with the hard inner shell 240. Regardless of the material and arrangement of the cushioning spacer layer 230, in one embodiment the cushioning material is affixed to the shell 220 and to the hard inner structure. Affixation can be done with glue, Velcro or any other affixation means.

In one embodiment, the hard ballistic-resistant inner shell 240 is comprised of a ballistic-resistant fibrous material. In one embodiment the inner shell material comprises a para-aramid synthetic fiber such as KEVLAR (a trademark of DuPont of Wilmington, Del.). In another embodiment the inner shell material comprises TWARON (a trademark of Teijin Twaron, B.V. of the Netherlands). In another embodiment, the inner shell material comprises ultra-high-molecular-weight polyethylene. As previously mentioned, in one embodiment the hard ballistic-resistant shell 240 is affixed to the spacer layer 230. Affixation can be done with glue, Velcro or any other affixation means. By way of example and not by way of limitation, the hard ballistic-resistant shell is between 2 mm and 20 mm thick, although it may be thinner or thicker. As another example, the hard inner ballistic-resistant shell 240 is between 7 mm and 12 mm thick.

In one embodiment, the one or more innermost cushioning pad(s) 250 is comprised of foam. The foam may be an elastomeric, cellular foam or any other desirable foam. In another embodiment, the cushioning pad(s) 250 is comprised of a soft resilient thermoplastic polyurethane (TPU). In another embodiment, the cushioning pad(s) is comprised of open-cell polyurethane. In another embodiment, the cushioning pad(s) is comprised of closed cell polyolefin foam. In another embodiment, the cushioning pad(s) is comprised of polyethylene foam which may be a high or low density polyethylene foam. In all embodiments, the hardness of the material innermost cushioning pad(s) is considerably lower than the hardness of the ballistic-resistant inner shell 240. In one embodiment the innermost cushioning pad 250 is a single pad defining multiple cut-outs (i.e., the equivalent of multiple connected pads). In another embodiment, a plurality of innermost cushioning pads 250 are provided. Regardless, the single pad with the cut-outs or the multiple pads are arranged in a desired configuration and are affixed to the hard inner structure 240. Affixation can be done with glue, Velcro or any other affixation means. By way of example and not by way of limitation, the innermost cushioning layer may be between 3 mm and 26 mm thick, although it may be thinner or thicker. By way of example, and not by way of limitation, the innermost cushioning pads may have a density of between 3.4 lbs/ft$^3$ (approximately 0.016 g/cm$^3$) and 25 lbs/ft$^3$ (approximately 0.4 g/cm$^3$), although they may be more dense or less dense.

In one embodiment, the innermost cushioning pad(s) 250 is covered by a fabric layer 260 (seen in FIG. 10). In one embodiment, fabric layer 260 is absorbent. In one embodiment fabric layer 260 is removable from the foam pad(s) 250. In one embodiment, the flexible thin cover is made from ballistic nylon, a high denier nylon thread with a dense basket wave such as Cordura (a trademark of Invista, Wichita, Kans.). In another embodiment, the flexible thin cover is made from a Neoprene (a trademark of DuPont, Del.) rubber (polychloroprene) fabric. In another embodiment, the flexible thin cover is made from a polyester fabric. In another embodiment, the flexible thin cover is made from non-woven fabric. By way of example only, the thin cover may be between 0.3 mm and 3.25 mm thick, although it may be thinner or thicker. By way of another example, the flexible thin cover may be between 1.0 mm and 1.5 mm thick.

Figure 12:
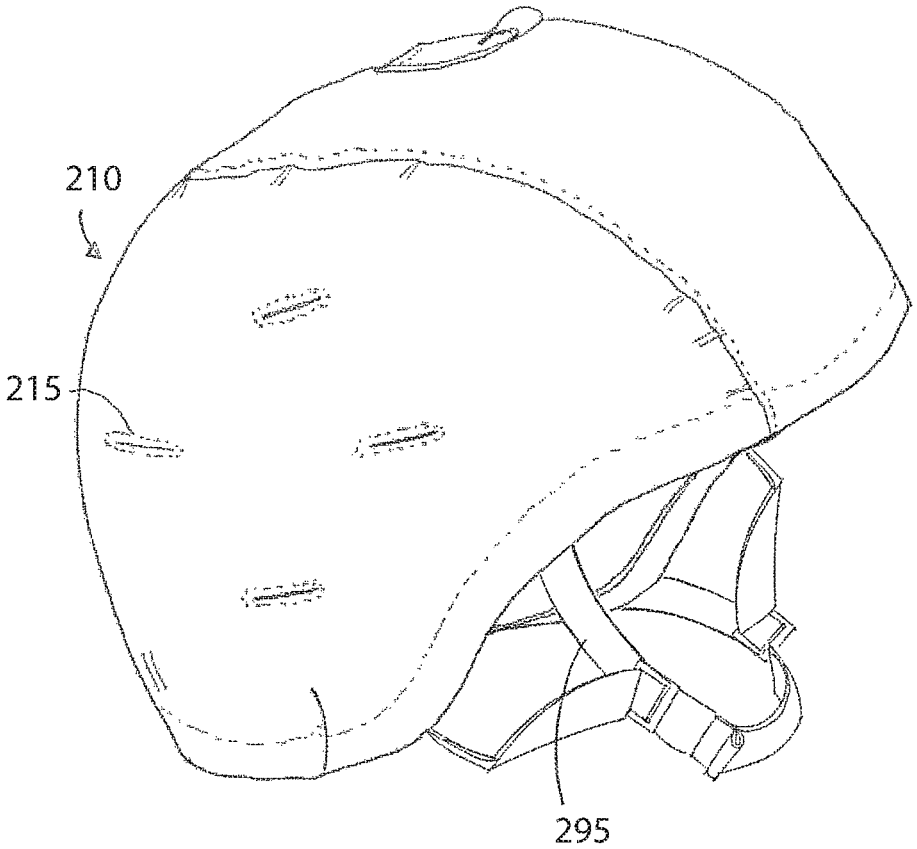
FIG. 12 is a perspective view of a military helmet including straps and accessories.

In one embodiment, and as suggested by FIG. 12, the military helmet 210 is adapted to be compatible with night vision devices (NVDs), communication packages, Nuclear, Biological and Chemical (NBC) defense equipment and body armor. In one embodiment, the military helmet 10 provides an unobstructed field of view and increased ambient hearing capabilities. In one embodiment, the military helmet 210 is provided with a chin strap retention system 295 (FIG. 12). In one embodiment, the military helmet 210 is provided with an armor nape pad (not shown). In one embodiment, the armor nape pad (not shown) is provided with a cushioning outer layer, a hard ballistic-resistant inner layer, a cushioning spacer layer located between and separating the cushioning outer layer and the hard ballistic-resistant inner layer, and a cushioning pad coupled to the inside surface of the hard ballistic-resistant inner layer. The outer surface of the cushioning outer layer of the nape pad and/or the inner surface of the cushioning pad coupled to the inside surface of the hard ballistic-resistant inner layer of the nape pad may be provided with a fabric layer.

In one embodiment small holes are drilled in one or both of the cushioning shell and in the anti-ballistic hard shell for ventilation purposes and/or for attaching straps or other structures. The attachment holes may be covered by ballistic screws, nuts or bolts. Regardless, it will be appreciated that the size and number of holes in the anti-ballistic hard shell is kept to a minimum to limit the potential of penetration of projectiles through the holes. For purposes of the claims, a shell structure having holes for these purposes should still be considered a "continuous shell".

The military helmet 210 has a concave outer surface and a convex inner surface. As seen in FIG. 10, the shape of the military helmet is adapted to cover the back, top, and sides of a soldier's head without blocking vision or hearing. As such, the bottom rim of the helmet angles upward from the back of the helmet toward the front of the helmet at a first angle $\alpha$, and then angles a steeper angle $\beta$ at about the ear area, and then extends substantially horizontally $\gamma$ at the forehead area.

The military helmets described are particularly suited for military use although they may be used for other purposes such as, by way of example only and not by way of limitation, a protective police helmet or an explosive ordinance disposal (EOD) helmet.

Figure 13:
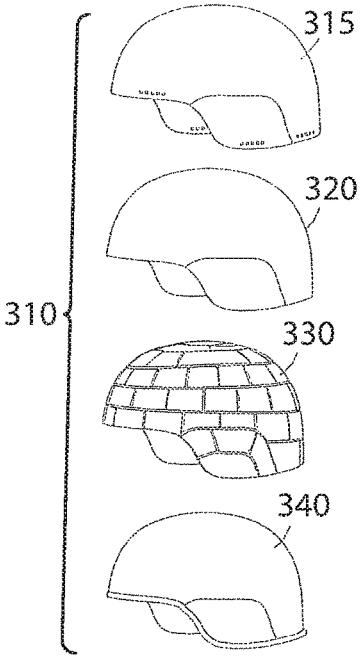
FIG. 13 is a perspective exploded view of an embodiment of a riot helmet.
Figure 16:
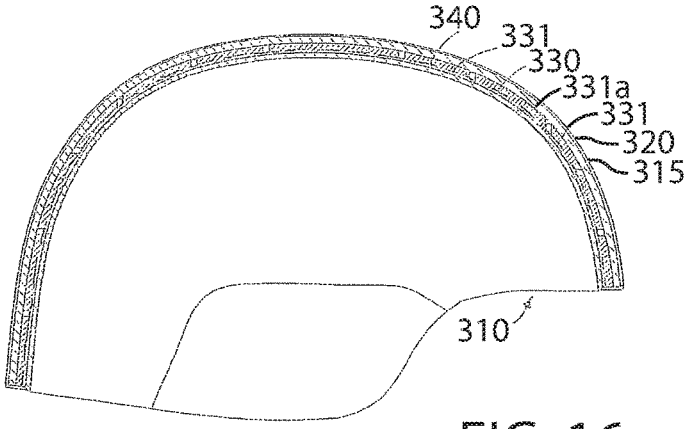
FIG. 16 is a cross-sectional view of the riot helmet of FIG. 13.
Figure 14:
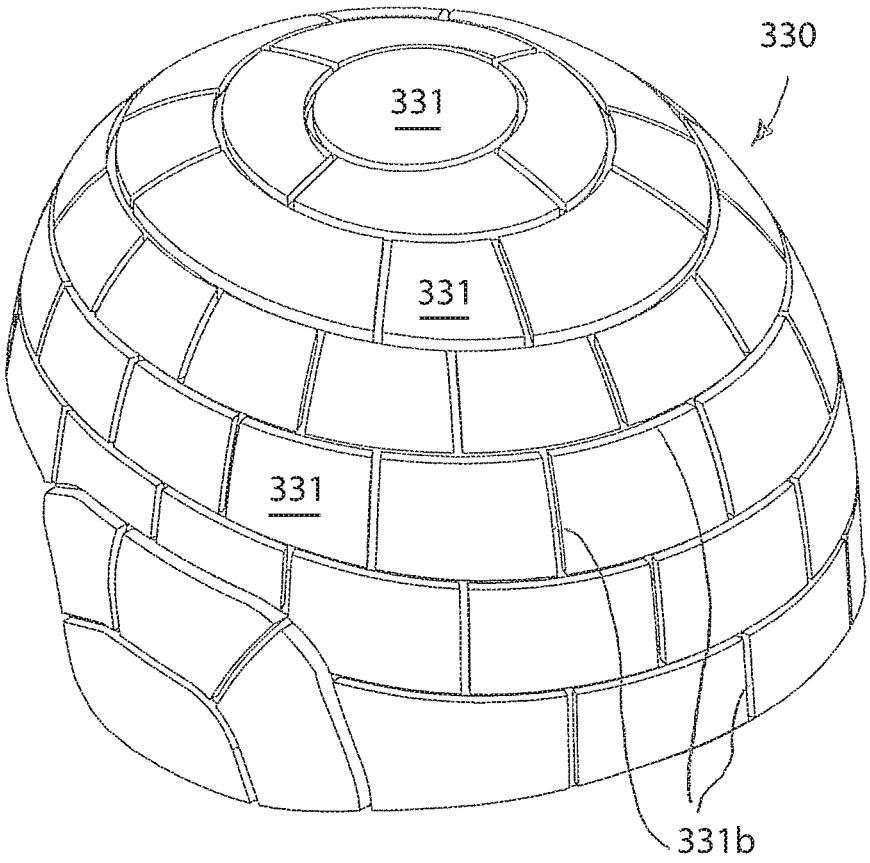
FIG. 14 is a perspective view of the cushioning spacer layer for the riot helmet of FIG. 13.

Turning now to FIGS. 13, 14 and 16 a riot helmet 310 is seen. Riot helmet 310 includes a multilayered system including an optional outermost cover 315, a cushioning outer shell 320 having a convex outer surface and a concave inner surface, a hard inner shell 340 with a convex outer surface and a concave inner surface, a cushioning spacer layer 330 located between and separating the cushioning outer shell 320 and the hard inner shell 340, and optional innermost cushioning pads (not shown) coupled to the inside surface of the hard inner shell 340.

In one embodiment, the flexible thin cover 315 may be a fabric, film, foil, leather (actual or imitation) or other cover such as a ballistic nylon (a high denier nylon thread with a dense basket weave) that is used as a cover for the helmet. The flexible thin cover may provide a surface for printing graphics. The flexible thin cover may also protect the cushioning outer shell from damage. If desired, the flexible thin cover may extend around the periphery of the helmet to protect the periphery of the cushioning shell 320 and the cushioning spacer layer 330 and optionally the hard inner shell 340. Alternatively, if desired, a flexible band may be used to extend around the periphery and cover the peripheral edge of cushioning shell 320, the spacer layer 330 and optionally the hard shell 340. By way of example only, the thin cover may be between 0.1 mm and 10 mm thick, although it may be thinner or thicker. By way of another example, the flexible thin cover may be between 0.3 mm and 3.25 mm thick. By way of another example, the flexible thin cover may be between 1.0 mm and 1.5 mm thick. The thin cover 315 may be attached at one or more places to the cushioning shell 320, so that the cover may be removed from the shell 320 without damaging the shell. Alternatively, the thin cover may be glued, tacked or sewn to the shell 320. In one embodiment, the thin cover 315 covers the entire cushioning shell 320.

In one embodiment the cushioning shell 320 is comprised of foam. The foam may be an elastomeric, cellular (including microcellular) foam or any other desirable foam. In another embodiment, the cushioning shell is comprised of a soft resilient thermoplastic polyurethane (TPU). In another embodiment, the cushioning shell is comprised of open-cell polyurethane. In another embodiment, the cushioning shell is comprised of closed cell polyolefin foam. In another embodiment, the cushioning shell is comprised of polyethylene foam which may be a high or low density polyethylene foam. In all embodiments, the hardness of the cushioning shell is much lower than the hardness of the inner shell 340. For example, the hardness of the cushioning shell is typically described by the Shore A Durometer scale (typically Shore A 60 and under, and even more typically Shore A 30 and under), whereas the hardness of the inner shell is described by the Shore D Durometer scale.

In one embodiment, the outer surface of the cushioning shell 320 is generally (hemi-)spherical in shape. By way of example and not by way of limitation, the cushioning shell may be between 3 mm and 13 mm thick, although it may be thinner or thicker. By way of example, and not by way of limitation, the cushioning shell may have a density of between 3.4 lbs/ft$^3$ (approximately 0.016 g/cm$^3$) and 30 lbs/ft$^3$ (approximately 0.48 g/cm$^3$), although it may be more dense or less dense.

As shown in FIGS. 13, 14 and 16, the cushioning spacer layer 330 comprises either a plurality of pads 331 that are coupled together by a thin underlayer 331*a* (indicated by dashed line in FIG. 16), or a single pad with multiple channels 331*b* (shown in FIG. 14) that define multiple pad areas 331. The pads 331 may assume multiple shapes and sizes. In another embodiment, the cushioning spacer layer 330 comprises a plurality of separated pads. In one embodiment the spacer layer 330 is comprised of a microcellular open cell urethane foam; e.g., PORON XRD, a trademark of Rogers Corporation, Rogers, Conn. In another embodiment, the spacer layer 330 comprises a foam that may be an elastomeric, cellular (including microcellular) foam or any other desirable foam. In another embodiment, the cushioning spacer layer 330 is comprised of a soft resilient thermoplastic polyurethane (TPU). In another embodiment, the cushioning spacer layer is comprised of open-cell polyurethane. In another embodiment, the cushioning spacer layer is comprised of closed cell polyolefin foam. In another embodiment, the cushioning spacer layer is comprised of polyethylene foam which may be a high density or low density polyethylene foam. In another embodiment, the cushioning spacer layer 330 has multiple layers formed from different materials. In all embodiments, the hardness of the cushioning spacer layer material is much lower than the hardness of the ballistic-resistant inner shell. By way of example and not by way of limitation, the cushioning spacer layer may be between 3 mm and 26 mm thick, although it may be thinner or thicker. As another example, the cushioning spacer layer may be between 6 and 13 mm thick. By way of example, and not by way of limitation, the cushioning spacer layer may have a density of between 3.4 lbs/ft$^3$ (approximately 0.016 g/cm$^3$) and 30 lbs/ft$^3$ (approximately 0.48 g/cm$^3$), although it may be more dense or less dense. By way of example, and not by way of limitation, the cushioning spacer layer has a hardness of between 2 and 30 on the Shore A scale.

As shown in FIGS. 13, 14, and 16, the spacer layer 330 covers approximately ninety-five percent of the inner surface area of the shell 320 and one hundred percent of the outer surface of the hard shell 340 (with underlayer 331*a*). In another embodiment, the spacer layer 330 covers between twenty percent and eighty percent of the inner surface area of the shell. In one embodiment the cushioning material is affixed to the shell 320 and to the hard inner structure. Affixation can be done with glue, Velcro or any other affixation means.

Figure 15:
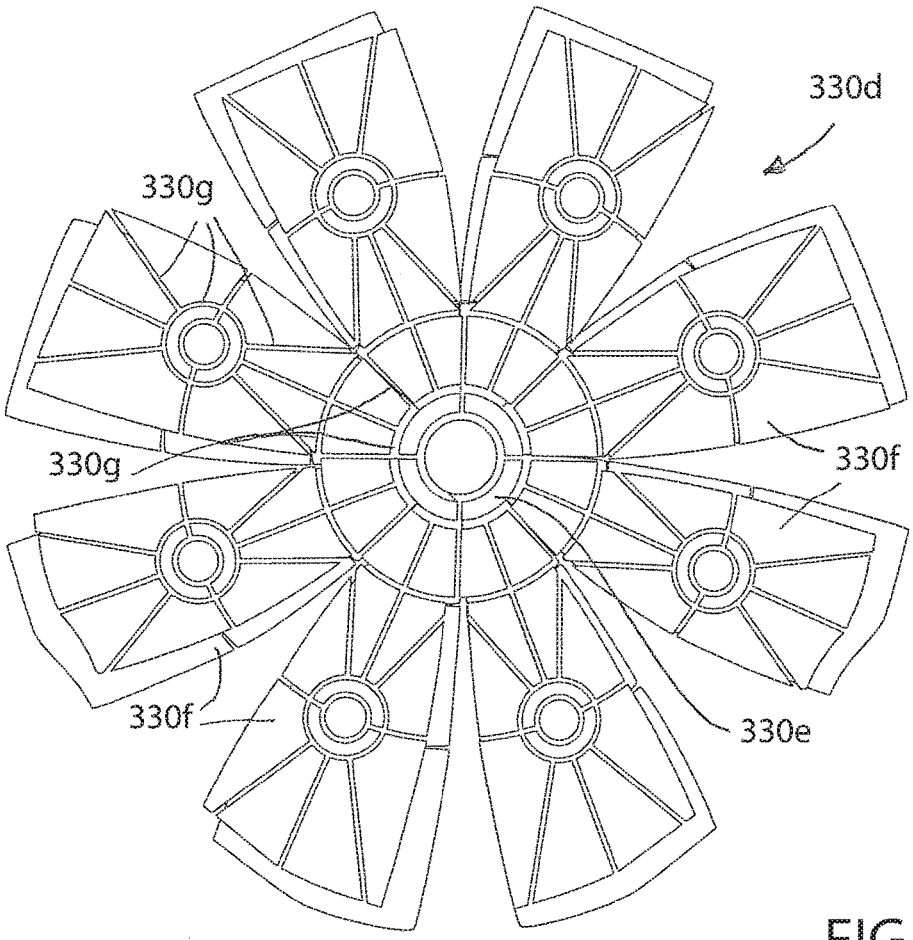
FIG. 15 is a view of an alternate cushioning spacer layer for the riot helmet.

An alternative spacer layer 330*d* is seen in FIG. 15. Spacer layer 330*d* may be made from any of the materials previously described with respect to spacer layer 330. Spacer layer 330*d* is shown cut from sheet material, such that spacer layer 330*d* takes the form of a flower with a central area 330*e* and petals 330*f*. Grooves 330*g* extending into, but not completely through the material of spacer layer 330*d* are formed in the petals and the central area and add to the flexibility of the spacer layer 330*d* so that it may be placed between the formed cushioning shell 320 and the formed hard shell 340 and assume a three-dimensional position with the petals 300*f* either touching each other or more closely spaced.

In one embodiment, the hard inner shell 340 is comprised of a carbon fiber material. In one embodiment the inner shell material comprises a para-aramid synthetic fiber such as KEVLAR (a trademark of DuPont of Wilmington, Del.). In another embodiment the inner shell material comprises TWARON (a trademark of Teijin Twaron, B.V. of the Netherlands). In another embodiment, the inner shell material comprises ultra-high-molecular-weight polyethylene. In one embodiment the hard shell 340 is affixed to the spacer layer 330 (or 330*d*). Affixation can be done with glue, Velcro or any other affixation means. By way of example and not by way of limitation, the hard shell is between 2 mm and 20 mm thick, although it may be thinner or thicker. As another example, the hard inner shell 340 is between 7 mm and 12 mm thick.

Additional pads (not shown) may be provided inside the hard inner shell 340.

Figure 17:
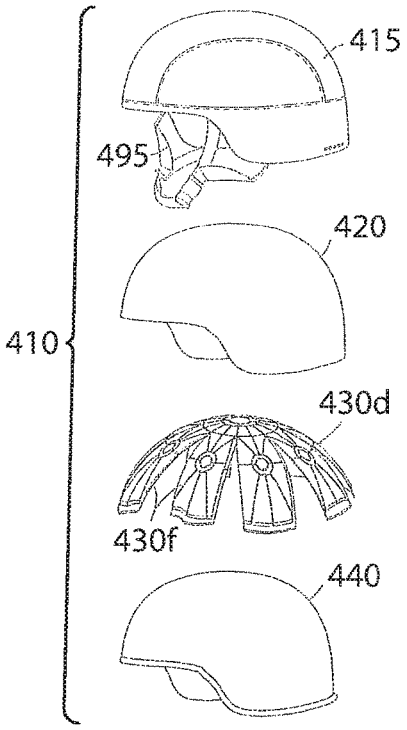
FIG. 17 is a perspective exploded view of an embodiment of a helmet utilizing the alternate cushioning spacer layer of FIG. 15.

FIG. 17 is a perspective exploded view of an embodiment of a helmet 410 utilizing aspects of the other helmet embodiments with like parts having like numbers separated by one hundred, two hundred, three hundred or four hundred. Helmet 410 includes an optional outermost cover 415, a cushioning outer shell 420 having a convex outer surface and a concave inner surface, a hard inner shell 440 with a convex outer surface and a concave inner surface, a cushioning spacer layer 430*d* located between and separating the cushioning outer shell 420 and the hard inner shell 440. Helmet 410 combines aspects of previously described embodiments. Thus, outermost cover 415 is provided with chin straps 495 (similar to the military helmet 210 of FIG. 12), and the cushioning spacer layer 430*d* is substantially the same as the alternate cushioning spacer layer 330*d* of the riot helmet of FIG. 15. Cushioning spacer layer 430*d* is shown in a partly rounded configuration in FIG. 17, and when assembled, the leaves 430*f* will assume a configuration where they are more closely adjacent each other at their circumferences. The materials and other aspects of the layers are as previously described with respect to the other embodiments.

Figure 18:
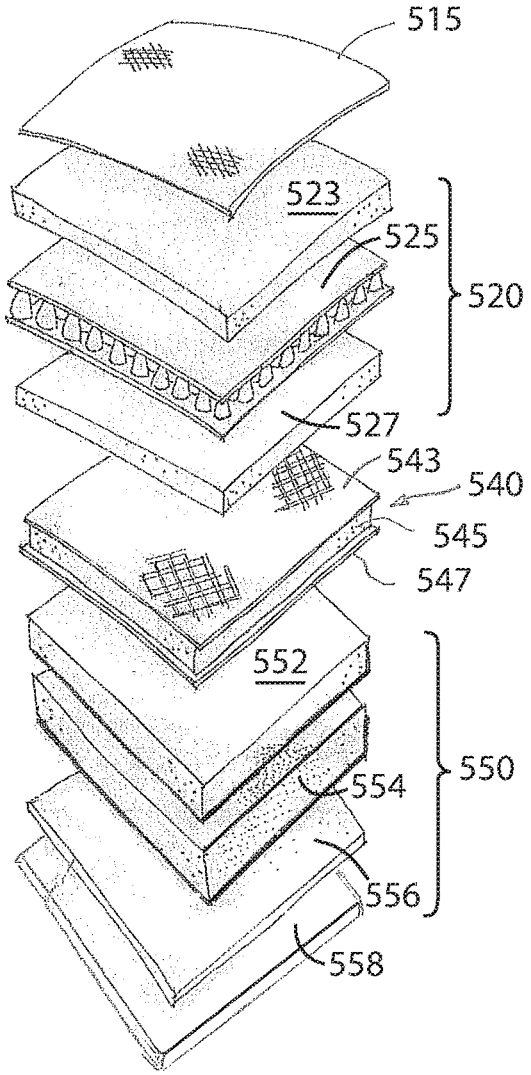
FIG. 18 is a perspective exploded view of layers of an embodiment of a helmet.

FIG. 18 is a perspective exploded view of layers of an embodiment of a helmet which can be a football helmet, an ice-hockey helmet, a baseball helmet, a motorcycle helmet, a riot helmet, a military helmets and any other helmets. The helmet includes an optional outermost cover 515, a cushioning outer multilayer structure 520 with at least two outer cushioning layers having different densities and different geometric layouts, a hard multilayer structure 540 located inside the outer cushioning layers, and a cushioning inner structure 550 550 inside the hard multilayer structure 540. Each of the cover 515, cushioning outer multilayer structure 520, and hard multilayer structure 540, have a generally convex outer surface and a generally concave inner surface.

In the embodiment shown in FIG. 18, the cushioning outer multilayer structure 520 includes three cushioning layers with a cushioning outer shell 523 formed from a foam such as a microcellular urethane foam (e.g., PORON) or expanded polystyrene (EPS) foam, an intermediate springy layer 525 (e.g., a thermoplastic polyurethane-air system such as SKYDEX—a trademark of Skydex Technologies, Inc. of Englewood Colo.), and a relatively inner spacer layer 527 of foam such as a PORON or EPS foam. One or both of the intermediate layer 525 and inner spacer layer 527 of the cushioning outer multilayer structure 520 is provided with a different geometry than the cushioning outer shell 523 and is arranged to redirect energy transmitted from the cushioning outer shell along a circuitous path. In addition, in one embodiment, the spacer layer 527 is provided with a different density than the density of the outer shell 523. By way of example only, the outer shell 523 may have a density of between 9 and 25 pounds per cubic foot (pcf) (approximately 144-400 kg/m$^3$) and the inner spacer layer 527 may have a different density in that range. In one embodiment, the outer shell density is lower than the inner spacer layer density. In one embodiment, rather than utilizing an intermediate layer such as shown, only two layers of foam 523, 527 are utilized with different densities and with different geometries such as shown in the different embodiments of FIGS. 1, 8, 13 and 17. In another embodiment, an intermediate foam layer is utilized, with the intermediate layer having a higher density than the densities of the outer shell and the inner spacer layer. In one embodiment, the thickness of the cushioning outer multilayer structure 520 is between 5 and 25 mm. In another embodiment, the thickness of the cushioning outer multilayer structure 520 is less than 15 mm. In another embodiment, the thickness of the cushioning outer multilayer structure is less than 10 mm.

In the embodiment shown in FIG. 18, the hard multilayer structure 540 located inside the outer cushioning layers is a multilayer structure with at least two hard layers 543, 547 and at least one cushioning layer 545 therebetween. By way of example only, the at least two hard layers 543, 547 may composite carbon fiber structures or polycarbonate, and by way of example only, the cushioning layer 545 may be structural foam such as PORON, EPS, or a liquid gel. In one embodiment, the hard layers such as carbon fiber layers 543, 547 are between 1 and 2 mm thick. In one embodiment, the thickness of the hard multilayer structure 540 is between 2 and 20 mm. In another embodiment, the thickness of the hard multilayer structure 540 is less than 10 mm. In one aspect, it is desirable for the hard multilayer structure 540 to be able to be bent or shaped into a shell-like shape while maintaining its ability to stop projectiles from penetrating the hard structure 540. In one embodiment, the hard layers 543, 547 are formed from ballistic resistant materials such as a para-aramid synthetic fiber or a ultra-high-molecular-weight polyethylene.

In the embodiment shown in FIG. 18, the cushioning inner structure 550 located inside the hard inner structure 540 includes four layers, including two cushioning foam layers 552, 554 having different densities and different geometric layouts, a sensor layer 556, and a thermal- or climate-control layer 558. In one embodiment, the two cushioning foam layers 552, 554 are similar in densities and geometry to the two outer cushioning foam layers 523, 527. The sensor layer 556 may be formed from foam or other cushioning material or a soft material such as fabric and as shown is located inside the inner cushioning foam layer 527, although it may be located between layers 523 and 527, or outside foam layer 523 and under the hard multilayer structure 540. The sensor layer 556 is provided with a plurality of impact sensors located about the helmet. Each sensor on the sensor layer may be self-powered, or the sensors may be powered by a single power source such as a battery (not shown). The sensors may collect impact acceleration function information along multiple axes and may provide the information wirelessly or otherwise. Exemplary sensors include the xPATCH sensor of X2 Biosystems Inc. of Seattle Wash., the BRAIN SENTRY sensor of Brain Sentry, Inc. of Bethesda, Md., the SHOCKBOX sensor of Impakt Protective Inc. of Kanata, Ontario, Canada, the CHECKLIGHT impact sensor system of Reebok, London, United Kingdom, and the INSITE sensor system of Riddell of Rosemont, Ill. The thermal-control layer 558 may likewise be formed from foam or other cushioning material and/or a soft material such as fabric and is provided as the innermost layer of the inner structure 550. In one embodiment, the thermal-control layer 558 includes a cooling fabric and a cooling bladder attached to the inside surface of the cooling fabric. In one embodiment, the thermal-control layer utilizes "passive" thermal control such as phase change materials that absorb, store and release heat. The phase change materials may be encapsulated in a polymer shell. An exemplary passive thermal-control layer 558 is formed from OUTLAST of Outlast Technologies, Inc., of Golden, Colo. In another embodiment, an "active" thermal control element such as a fan is provided in layer 558. The fan may be formed from polymeric materials and an airway may be provided to the exterior of the helmet.

In one embodiment, instead of the cushioning inner structure 550 including four layers, the inner structure 550 includes three layers 552, 554 and 558 and does not include the sensor layer. In another embodiment, instead of the cushioning structure 550 including four layers, the inner structure 550 includes three layers 552, 554 and 558, and impact sensors are provided in one of the three layers. In another embodiment instead of the cushioning inner structure 550 including four layers, the inner structure 550 includes three layers 552, 554 and 556, and does not include the thermal-control layer. In another embodiment, instead of the cushioning structure 550 including four layers, the inner structure 550 includes two foam layers 552, 554, and does not include the sensor layer or the thermal-control layer. In another embodiment, instead of the cushioning structure 550 including four layers, the inner structure 550 includes two foam layers 552, 554, and impact sensors are included in one of the foam layers 552, 554. In another embodiment, the cushioning structure 550 includes at least three foam layers with the middle foam layer having a relatively higher density than the other two layers. In another embodiment, instead of the cushioning inner structure 550 including multiple layers, the cushioning inner structure located inside the hard inner structure is a plurality of innermost cushioning pads coupled to the inside of the hard inner structure as shown or described in the different embodiments of FIGS. 1, 8, and 16.

In one aspect, as with previously described embodiments, the optional outermost cover 515 may be a fabric, film, foil, leather, ballistic nylon, or other cover. The flexible thin cover may be cosmetic and may provide a surface for printing graphics. The flexible thin cover may also protect the cushioning outer shell from damage.

In one embodiment, the helmet is at most 50 mm thick.

In one aspect, the hardness of the hard layers 543, 547 may be characterized by a hardness on the Shore D Durometer scale (typically Shore D 75 and over), whereas generally, the hardness of the material of the cushioning layer 545 between the hard layers (and the materials of the cushioning outer multilayer structure) is characterized by a hardness on the Shore A Durometer scale (typically Shore A 60 and under, and even more typically Shore A 30 and under).

Figure 19A:
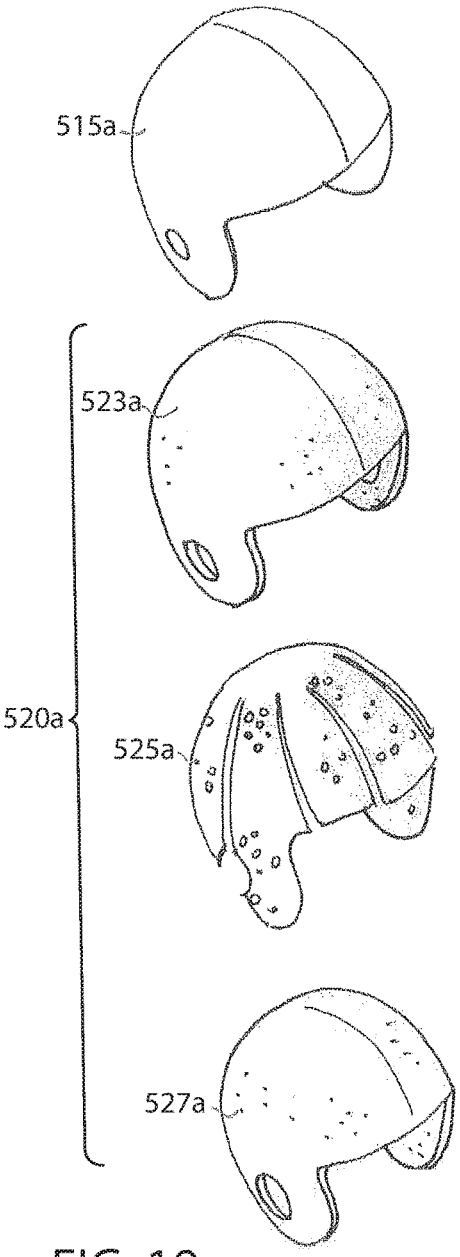
FIGS. 19*a*-19*c* are respectively a perspective exploded view of the outer layers of a portion of a football helmet, a perspective view of a hard multilayer of a portion of a football helmet, and a perspective exploded view of the inner layers of a portion of a football helmet.
Figure 19C:
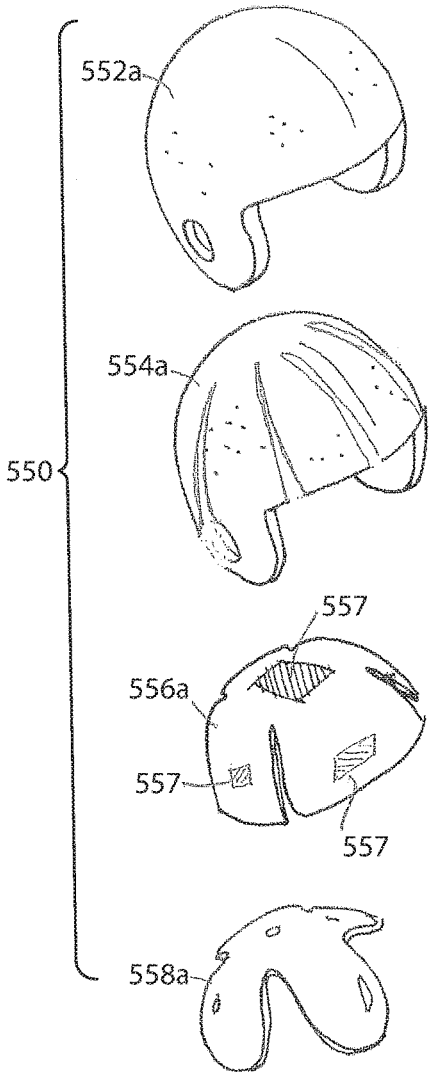
Figure 19B:
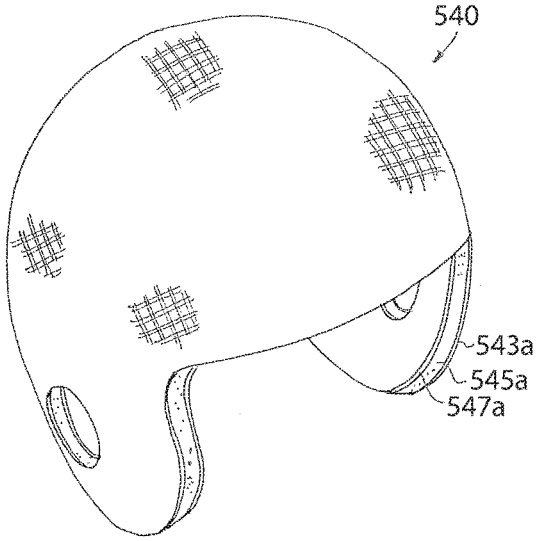

Turning now to FIGS. 19*a*-19*c*, a perspective exploded view of a portion of a football helmet is shown generally corresponding to the layers of FIG. 18. FIG. 19*a* shows a cushioning outer multilayer structure 520*a*, FIG. 19*b* showing the hard multilayer structure 540*a*, and FIG. 19*c* showing an inner cushioning structure 550*a*. No facemask is shown. As seen in FIG. 19*a*, an outermost covering 515*a* is provided. In addition, a cushioning outer multilayer structure 520*a* includes three cushioning layers with a cushioning outer shell 523*a* formed from a foam such as, by way of example only, a microcellular urethane foam (e.g., PORON) or EPS, an intermediate springy layer 525*a* (e.g., a thermoplastic polyurethane-air system such as SKYDEX, and a relatively inner spacer layer 527*a* of foam such as a PORON foam or EPS. In FIG. 19*a*, the intermediate layer 525*a* is provided with a different geometry than the cushioning outer shell 523*a* and is arranged to redirect energy transmitted from the cushioning outer shell along a circuitous path. In addition, in one embodiment, the spacer layer 527*a* is provided with a different density than the density of the outer shell 523*a*. By way of example only, the outer shell 523*a* may have a density of between 9 and 25 pcf, and the inner spacer layer 527*a* may have a different density in the same range In one embodiment, rather than utilizing an intermediate layer 525*a* such as shown, only two layers of foam 523*a*, 527*a* are utilized with different densities and with different geometries such as shown in the different embodiments of FIGS. 1, 8, 13 and 17. In another embodiment, three layers of foam are utilized with the middle foam layer having a higher density than the other two layers. In one embodiment, the thickness of the cushioning outer multilayer structure 520*a* is between 5 and 25 mm. In another embodiment, the thickness of the cushioning outer multilayer structure 520*a* is less than 15 mm. In another embodiment, the thickness of the cushioning outer multilayer structure 520*a* is less than 10 mm.

As shown in FIG. 19*b*, the hard multilayer structure 540*a* located inside the outer cushioning layers is a multilayer structure with at least two hard layers 543*a*, 547*a* and at least one cushioning layer 545*a* therebetween. By way of example only, the at least two hard layers 543*a*, 547*a* may composite carbon fiber structures or polycarbonate, and the cushioning layer 545*a* may be structural foam such as PORON or EPS, a springy layer made from SKYDEX, a liquid gel, or another cushioning material. In one embodiment, the carbon fiber or polycarbonate layers 543*a*, 547*a* are between 1 and 2 mm thick. In one embodiment, the thickness of the hard multilayer structure 540*a* is between 2 and 20 mm. In another embodiment, the thickness of the hard multilayer structure 540*a* is less than 10 mm. In one aspect, it is desirable for the hard multilayer structure 540*a* to be able to be bent or shaped into a shell-like shape while maintaining its ability to stop projectiles from penetrating the hard structure 540*a*.

As shown in FIG. 19*c*, the cushioning inner structure 550*a* located inside the hard inner structure 540*a* includes four layers, including two cushioning foam layers 552*a*, 554*a* having different densities and different geometric layouts, a sensor layer 556*a*, and a thermal-control layer 558*a*. In one embodiment, the two cushioning foam layers 552*a*, 554*a* are similar in densities to the two outer cushioning foam layers 523*a*, 527*a* (with the geometries being similar to the cushioning foam layer 523*a* and the springy layer 525*a*). The sensor layer 556*a* may be formed from foam or other cushioning material or a soft material such as fabric and as shown is located inside the inner cushioning foam layer 527*a*, although it may be located between layers 523*a* and 527*a*, or outside foam layer 523*a* and under the hard multilayer structure 540*a*. The sensor layer 556*a* is provided with a plurality of impact sensors 557 (three shown) located about the helmet. Each sensor on the sensor layer may be self-powered, or the sensors may be powered by a single power source such as a battery (not shown). The sensors may collect impact acceleration function information along multiple axes and may provide the information wirelessly or otherwise. Exemplary sensors may be those previously described with reference to FIG. 18. The thermal-control layer 558*a* may likewise be formed from foam or other cushioning material or a soft material such as fabric and is provided as the innermost layer of the inner structure 550*a*. In FIG. 19*c*, the thermal-control layer utilizes "passive" thermal control such as phase change materials that absorb, store and release heat. The phase change materials may be encapsulated in a polymer shell. An exemplary passive thermal-control layer 558*a* may be as previously described with reference to FIG. 18.

Figure 20:
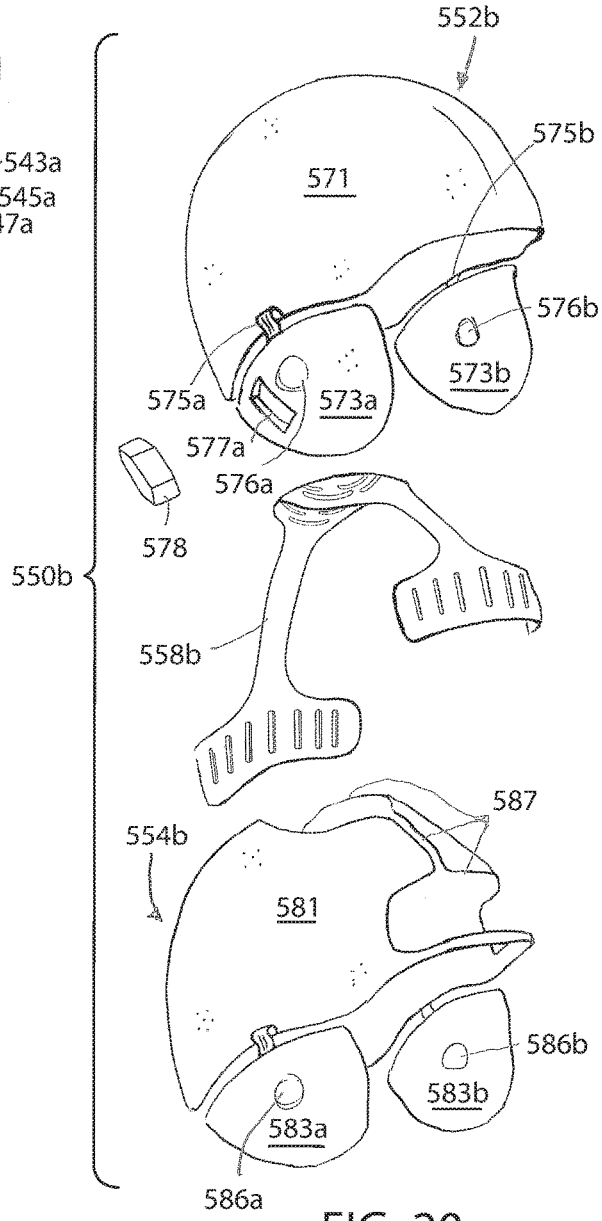
FIG. 20 is an exploded view of another embodiment of the inner layers of a helmet.

Turning now to FIG. 20, another embodiment of a cushioning inner structure 550*b* is shown for a helmet such as a football helmet, but not limited thereto. The cushioning inner structure 550*b* includes two cushioning foam layers 552*b*, 554*b* having different densities and different geometric layouts. Cushioning foam layer 552*b*, which is attached to the inside of the hard layer, is shown with a main skull pad 571, and two ear pads 573*a*, 573*b* which are optionally tethered to the main skull pad 571 by tethers 575*a*, 575*b*. Each of the ear areas defines a hole 576*a*, 576*b* (for hearing) and is further provided with a cut-out or depression 577*a* (only one shown) for an impact or acceleration concussion sensor 578 (only one shown). Cushioning foam layer 552*b* may be provided with additional cut-outs or depressions for housing additional sensors. Thus, cushioning foam layer 552*b* also serves as a sensor layer. Cushioning foam layer 554*b* is likewise shown with a main skull pad 581 and two ear pads 583*a*, 583*b* (with holes 586*a*, 586*b*) which are optionally tethered to the skull pad 581 by tethers 585*a*, 585*b*. Main skull pad 581 of foam layer 554*b* is provided with a cut-out or depression 587 for a cooling bladder 558*b*. The cut-out or depression 587 is shown running from the forehead area of the main skull pad 581, to the top of the head, and it further extends from the top of the head down the back of the head to the back of the neck area of the helmet. The inside of the cooling bladder 558*b* and the foam layer 554*b* may be lined with another material if desired. Thus, cushioning layer 554*b* also serves as a thermal-control layer. The foam material may be selected to be the same material as discussed above with reference to other embodiments, or other materials may be used. Likewise, the sensors 578 and the cooling bladder 558*b* may be the same as previously described, or other sensors or thermal-control elements may be used.

There have been described and illustrated herein several embodiments of a helmet. While particular embodiments have been described, it is not intended that the claims be limited thereto, as it is intended that the claims be as broad in scope as the art will allow and that the specification be read likewise. Thus, while particular materials for cushioning layers have been disclosed, it will be appreciated that other materials may be used as well. Similarly, while particular types of materials have been disclosed for the hard structural layer, it will be understood that other materials can be used. Also, while particular types of materials for the cover layers have been described, other materials can be used. In addition, while the shell was shown as being continuous, it will be appreciated that small holes may be drilled in the shell structure for ventilation purposes and for attaching straps or other structures. For purposes of the claims, such a shell should still be considered "continuous". It will therefore be appreciated by those skilled in the art that yet other modifications could be made without deviating from the spirit and scope of the claims.

What is claimed is:

1. A protective helmet comprising:

a cushioning outer multilayer structure comprising two cushioning layers of materials having different densities and different geometric layouts, said cushioning outer multilayer structure having a concave interior surface and a convex exterior surface;

a multilayer hard inner structure having a concave interior surface and a convex exterior surface, said concave exterior surface of said hard inner structure attached to said concave interior surface of said cushioning multilayer structure, said multilayer hard inner structure including at least two spaced layers of hard material and a layer of cushioning material therebetween, said hard material being harder than said materials of said two cushioning layers of said outer multilayer structure and being harder than said material of said cushioning material of said multilayer hard inner structure; and an innermost cushioning structure attached to said concave inner surface of said multilayer hard inner structure.

2. A protective helmet according to claim 1, further comprising:

a flexible thin cover extending around said convex exterior surface of said cushioning outer multilayer structure.

3. A protective helmet according to claim 1, wherein:

said cushioning outer multilayer structure comprises an outer foam shell having a concave inner surface and a foam layer, inward of the outer foam shell, the foam layer only partially covering said concave inner surface of said outer foam shell and including structure defining gaps.

4. A protective helmet according to claim 3, wherein:

said cushioning outer multilayer structure is less than 15 mm in thickness.

5. A protective helmet according to claim 1, wherein:

said cushioning outer multilayer structure comprises an outer foam shell, a foam layer positioned inward relative to the outer foam shell, and a springy layer between said outer foam shell and said foam layer.

6. A protective helmet according to claim 1, wherein:

said multilayer hard inner structure is between 1 and 10 mm thick.

7. A protective helmet according to claim 6, wherein:

said two spaced layers of hard material comprise at least one of carbon fiber structures, polycarbonate, para-arimid synthetic fiber, and ultra-high-molecular-weight polyethylene.

8. A protective helmet according to claim 7, wherein:

each of said two spaced layers of hard materials is between 1 and 2 mm thick.

9. A protective helmet according to claim 7, wherein:

said layer of cushioning material of said multilayer hard inner structure comprises one of foam and gel.

10. A protective helmet according to claim 1, wherein:

said innermost cushioning structure comprises two cushioning foam layers having different densities and different geometric layouts.

11. A protective helmet according to claim 10, wherein:

said innermost cushioning structure further comprises a plurality of impact sensors.

12. A protective helmet according to claim 11, wherein:

said plurality of impact sensors are contained in at least one of said two cushioning foam layers of said innermost cushioning structure.

13. A protective helmet according to claim 11, wherein:

said innermost cushioning structure comprises a third cushioning layer containing said plurality of impact sensors.

14. A protective helmet according to claim 10, wherein:

said innermost cushioning structure comprises an innermost thermal-control layer.

15. A protective helmet according to claim 14, wherein:

said innermost thermal-control layer is a passive thermal control layer.

16. A protective helmet according to claim 8, wherein:

said innermost cushioning structure comprises two cushioning foam layers having different densities and different geometric layouts.

17. A protective helmet according to claim 16, wherein:

said innermost cushioning structure further comprises a plurality of impact sensors.

18. A protective helmet according to claim 16, wherein:

said innermost cushioning structure comprises an innermost thermal-control layer.

19. A protective helmet according to claim 16, wherein:

said cushioning outer multilayer structure comprises an outer foam shell having a concave inner surface and a foam layer, disposed inward of the outer foam shell, the foam layer only partially covering said concave inner surface of said outer foam shell and including structure defining gaps.

20. A protective helmet according to claim 19, wherein:

said cushioning outer multilayer structure is less than 15 mm in thickness.

21. A protective helmet according to claim 20, wherein:

said protective helmet has a thickness of at most 50 mm.

22. A protective helmet according to claim 16, wherein:

said cushioning outer multilayer structure comprises an outer foam shell, a foam layer positioned inward of the outer foam shell, and a springy layer between said outer foam shell and said foam layer.

* * * * *